US008056901B2

(12) United States Patent
Charney

(10) Patent No.: US 8,056,901 B2
(45) Date of Patent: Nov. 15, 2011

(54) EDUCATIONAL KIT AND METHOD FOR TEACHING ACADEMIC AND VOCATIONAL SUBJECTS

(76) Inventor: Fred Charney, Manati, PR (US)

( * ) Notice: Subject to any disclaimer, the term of this patent is extended or adjusted under 35 U.S.C. 154(b) by 0 days.

(21) Appl. No.: 12/782,389

(22) Filed: May 18, 2010

(65) Prior Publication Data

US 2010/0289216 A1 Nov. 18, 2010

Related U.S. Application Data

(60) Provisional application No. 61/179,232, filed on May 18, 2009.

(51) Int. Cl.
*A63F 7/00* (2006.01)
*A63H 5/00* (2006.01)

(52) U.S. Cl. ..... 273/283; 273/237; 273/242; 463/1; 463/9; 463/47

(58) Field of Classification Search ..... None
See application file for complete search history.

(56) References Cited

U.S. PATENT DOCUMENTS 4,484,749 A * 11/1984 Charney ..... 273/283
4,629,195 A * 12/1986 Charney ..... 273/254
5,624,119 A * 4/1997 Leake ..... 273/269
6,270,077 B1 8/2001 Cohen
2001/0034258 A1 * 10/2001 Darden et al. ..... 463/9
2005/0266906 A1 * 12/2005 Stevens ..... 463/1
2005/0288078 A1 12/2005 Cheok et al.
2006/0273509 A1 12/2006 Davis et al.
2008/0199837 A1 * 8/2008 Kuester et al. ..... 434/129
2009/0091087 A1 4/2009 Wasmund

OTHER PUBLICATIONS

PCT International Search Report and Written Opinion mailed on Jul. 20, 2010, for PCT/US2010/035623.

* cited by examiner

*Primary Examiner* — Dmitry Suhol
*Assistant Examiner* — Matthew Russell
(74) *Attorney, Agent, or Firm* — Kenyon & Kenyon LLP

(57) ABSTRACT

A system includes software for customization of one or more game boards or elements, and/or for educational game play. An example embodiment includes a plurality of polygonal game-board segments, which can be assembled into a game-board, where each game-board segment presents spots upon which a player may "land." The spots for each game-board segment may be logically connected to form a path of the game. Additional accessories may include: player pieces, a timer token, game cards, game metric identifiers (e.g., points, money, etc.), and a randomized movement indicator (e.g., dice). The software may be used for selection of educational categories, sub-categories, and elements for construction of game segments of the game-board, and may also be used for constructing, administrating, grading, and storing results of quizzes (which may be used for construction and/or playing of the game using the game board) and a played game, and/or for otherwise facilitating game play.

24 Claims, 23 Drawing Sheets

Travel–Points

Question Sheet & Scorecard --- U.S. Geography

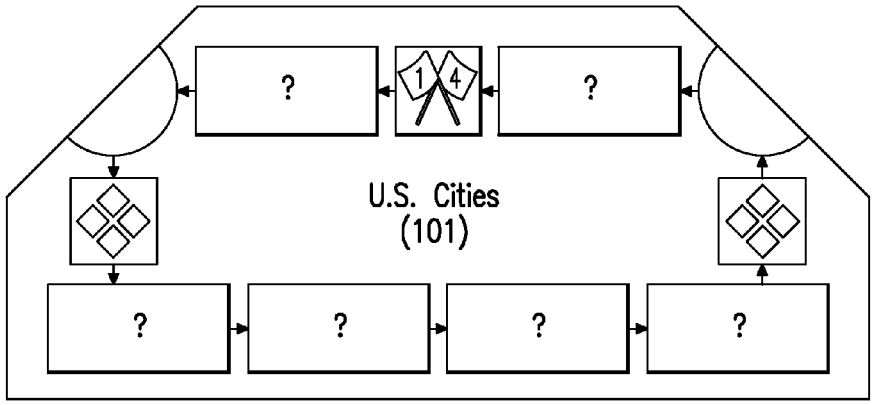

Above is a Travel-Map which has only a question mark in each of its six Info Boxes. Below are twelve possible Info Boxes. Which are the six boxes you think are correct and belong to the Travel-Map? Circle the six boxes.

| | | | |
|---|---|---|---|
| Akron, Michigan | Fresno, CA | El Paso, Texas | Norfolk, SC |
| El Paso, NM | Norfolk, Virginia | Las Vegas, Nevada | Denver, Florida |
| Akron, Ohio | Las Vegas, CA | Denver, Colorado | Fresno, WA |

Bonus points are received when playing Travel-Game that includes this map.
Scorecard Valid Only Once.

Quiz-Tour ID:_____ Traveler Name:_____

Date/Time:_____ Correct Selections:____ Bonus Points:_____

FIG.8B

EDUCATIONAL KIT AND METHOD FOR TEACHING ACADEMIC AND VOCATIONAL SUBJECTS

CROSS-REFERENCE TO RELATED APPLICATION

This application claims priority under 35 U.S.C. §119(e) to U.S. Provisional Patent Application Ser. No. 61/179,232, filed on May 18, 2009, the entire contents of which are expressly incorporated herein by reference.

FIELD OF THE INVENTION

The present invention relates to systems and methods for providing a customizable educational board game, with both digital and material aspects.

COPYRIGHT NOTICE

A portion of the disclosure of this patent document contains material to which a claim for copyright is made. The copyright owner has no objection to the facsimile reproduction by anyone of the patent document or the patent disclosure, as it appears in the Patent and Trademark Office patent file or records, but reserves all other copyright rights whatsoever.

BACKGROUND INFORMATION

Educational institutions often seek out ways to present coursework in a way that is both fun and educational to the student body. Further, group learning has unique benefits, allowing a greater educational experience when used in conjunction with individual learning. Often times, games are played that impart educational information to a student, so that the enjoyment of learning is increased. However, the coursework within a single formative year of education is expansive, diverse, and ever changing as educational theory is improved and refined. Thus, certain specific games are used as specific points in the material, as a supplement to the normal lesson plan. Also, these games, are often replaced or rendered outdated. Even games with some degree of customization have an extremely limited set of options, and are usually presented in computerized form, since it is expensive to provide different variations of a material real space game.

SUMMARY

Example embodiments of the present invention are generally directed to a customizable and educational board game, with associated software. The inventive aspects of the present invention relate to both the construction (e.g., elements, assembly, design, etc.) and execution (e.g., play) of the game. Software may be associated with either or both of these aspects, providing tools for customization, and/or an interactive element/supplement to game play. In this way, the full adaptability of computerized systems, in conjunction with an ordinary home printer, affords the user a fully customizable game in material form, with accompanying electronic elements. Alternative embodiments may include a completely electronic version of game play, where players share a computer for group play, play against computer implemented competitors (e.g., Artificial Intelligence), or play against other people with a plurality of computers, either geographically distributed or at a single location, which computers are connected via a network.

An example embodiment of the present invention may include a game board including multiple interconnected and interchangeable segments, each segment including a plurality of game elements, the majority of which contain educational information related to a segment theme. The board may also include a time keeping segment for determining the game end. The board may be defined as a subset of a large plurality of available game segments, including fully customizable game segments based on a template. Each segment may be smaller than the customary printing area of a standard personal computer printer. The creation, selection, definition and construction of the game segments may be facilitated by templates and tools available on accompanying software, which may also print each segment on a standard size piece of paper. The printed segment may be smaller in area than the paper on which it is printed, and may require cropping with scissors before constructing the game board. The software may also facilitate the customization and printing of game currency/points, and game cards that are associated with the informational game elements. The software may also facilitate the customization and printing of game quizzes related to the information in the game segments. The software may also facilitate the customization and printing of a time keeping segment.

The printed and/or electronically presented items may be configured such that players may play a game on them using other game pieces. The board and pieces may be configured to facilitate the play of a game including the following. (1) Players roll dice and move, in the direction indicated by game arrows or directions, from a starting position towards an end position according to the number rolled. (2) The player performs a predefined action dependent on the type of game element the player lands on. (3) Via the different elements, the player may win or lose game points. (4) Upon a pre-determined event, the timer token is advanced, and upon a predetermined end point reached by the timer token, the game may end. (5) The point total of each player may determine the winner. (6) Optionally, game quizzes may be given in association with a game play, and those quizzes may provide bonus points. The game may be replayed as is, reconfigured, or completely changed. In this way, each game segment is completely modular for reuse in alternative game board arrangements.

Thus, an example embodiment may include software, a printed game board with accessories, and electronic or printed quizzes. The software may include tools to customize substantive aspects of the other materials, including game segments and quizzes.

Another example embodiment may include a system for providing an electronic and material game, including a database and processor. The database may be configured to store game segment templates and default game elements, in addition to user defined game elements and game segments. The system may present a template and various tools for defining new game segments to be stored in the database. The system may facilitate the defining of a new game board, using the stored game segments, and communicate with a printer to print out the game board segments. The pieces may be designed such that they can be combined by the user, after printing, into a single logical game.

Additional embodiments include the system where each game element is a piece of information, and all of the pieces on a particular game segment are related by a segment title or theme. Additionally, the segments may have other elements with different defined functions for game play. The game may include game cards that may correspond to elements of the game segments. The game cards may include a section corresponding to a game segment and an indication of how much the card is worth.

Example embodiments may include a supplemental game quiz, which may be generated by the system/user. The quiz may be presented on an electronic system for interaction by a user, or the quiz may be printed and administered on paper. The user may customize the quizzes, which may be based on the game segments associated with a defined game board. The associated quizzes may have a timing mechanism. Example embodiments may include a time keeping segment as part of the game board. Example embodiments may include a network connection for sharing game segments and boards, and for utilizing game segments and boards from distributed systems.

An example embodiment may include game segments of a half-octagon shape, such that four segments fit together to substantially form a large square or plus-sign shape, with a smaller square "hole" in the center where a similarly sized time keeper segment is placed. The combined pieces may form a logically contiguous game path for players to follow.

Example embodiments may include a board game kit, comprising a plurality of polygonal shaped segments, each having a plurality of game elements on both sides, the plurality of segments arranged to be logically or actually connected to each other, and the plurality of game elements arranged to form one or more logically interconnected paths regardless of which side of the segment is exposed.

The example board game kit may include a plurality of game cards associated with the plurality of game elements. The board of the example embodiment may be formed by placing a connecting edge of a polygonal shaped segment adjacent to a corresponding connecting edge of another polygonal shaped segment. The connecting edge may be an edge other than the segment's longest edge. Each segment may have half a game element at the edge of their connecting edges, so as to form a whole game element when the polygonal segments are attached. The example polygonal segments may be formed by affixing a board segment made of paper or similar to a rigid material of substantially the same shape. A second board segment may be affixed to the opposite side to form the two sided game segment.

Game segments and boards may be constructed with magnetic properties, which may provide flexibility in configuring and reconfiguring boards. For example, the rigid material to which printouts are affixed may be magnetic, and a magnetic base may be provided that is large enough for each segment to be affixed via the magnetic attraction of the segments and base. Alternatively, magnetic sheets capable of being run through a home printer are also available on the market, and could be used in conjunction with the example embodiments disclosed herein. These segments may allow a segment to be displayed on one side or both sides of the surface. Ideally, a two-sided segment configuration would include a structure magnetized on both sides, or otherwise configured to ensure an attraction in either orientation. Alternatively, a magnetic board may be used with traditional magnets, and regular board segments. That is, segments may be clamped in place on the board like a note on the refrigerator, and turned upside down by the removal and resetting of the clamping magnets.

Example embodiments of the present invention are directed to one or more processors, which may be implemented using any conventional processing circuit and device or combination thereof, e.g., a Central Processing Unit (CPU) of a Personal Computer (PC) or other workstation processor, to execute code provided, e.g., on a hardware computer-readable medium including any conventional memory device, to perform any of the methods described herein, alone or in combination. Those methods include steps, described herein, for generating a game board and/or associated material, such as quizzes, game cards, and time and token movement control elements, for example, based on user input received via a user interface device, such as a touch-screen, keyboard, mouse, etc. Those methods also include steps, described herein, for game play on a computing device, for example in accordance with user input, including, for example, movement of tokens in accordance with a token movement control element and user input decisions, such as path selection, and other user input, such as answers to single questions, taking of quizzes, a segment-flip instruction, etc.

The one or more processors may be embodied in a server or user terminal or combination thereof. The user terminal may be embodied, for example, a desktop, laptop, hand-held device, Personal Digital Assistant (PDA), television set-top Internet appliance, mobile telephone, smart phone, etc., or as a combination of one or more thereof. The memory device may include any conventional permanent and/or temporary memory circuits or combination thereof, a non-exhaustive list of which includes Random Access Memory (RAM), Read Only Memory (ROM), Compact Disks (CD), Digital Versatile Disk (DVD), and magnetic tape.

Example embodiments of the present invention are directed to one or more hardware computer-readable media, e.g., as described above, having stored thereon instructions executable by a processor to perform the methods described herein or portions thereof.

Example embodiments of the present invention are directed to the methods, e.g., computer-implemented methods, for example, of a hardware component(s) or machine(s), described herein, or portions thereof.

Example embodiments of the present invention are directed to a method, e.g., of a hardware component(s) or machine(s), of transmitting instructions executable by a processor to perform the methods described herein, or portions thereof.

BRIEF DESCRIPTION OF THE DRAWINGS

FIGS. 8A and 8B illustrate example game quizzes that are used with example embodiments of the present invention.

DETAILED DESCRIPTION

Example embodiments of the present invention are generally directed to a customizable and educational board game, with associated software. The inventive aspects of the present invention relate to both the construction (e.g., elements, assembly, design, etc.) and execution (e.g., play) of the game. Software may be associated with either or both of these aspects, providing tools for customization, and/or an interactive element/supplement to game play. This detailed description will outline each of these aspects in turn.

Example embodiment of the present invention are directed to a system that facilitates generation of an educational board game and/or for providing an interactive computerized educational game according to the various methods described herein.

Example embodiments of the present invention are directed to the various methods described herein for generating an educational game, for playing an educational game, and/or keeping score for a played game.

Example embodiments of the present invention relate to hardware computer-readable media having stored thereon instructions executable by a processor, the instructions which, when executed, cause the processor to perform the various methods described herein.

Game Elements and Construction

Figure 1A:
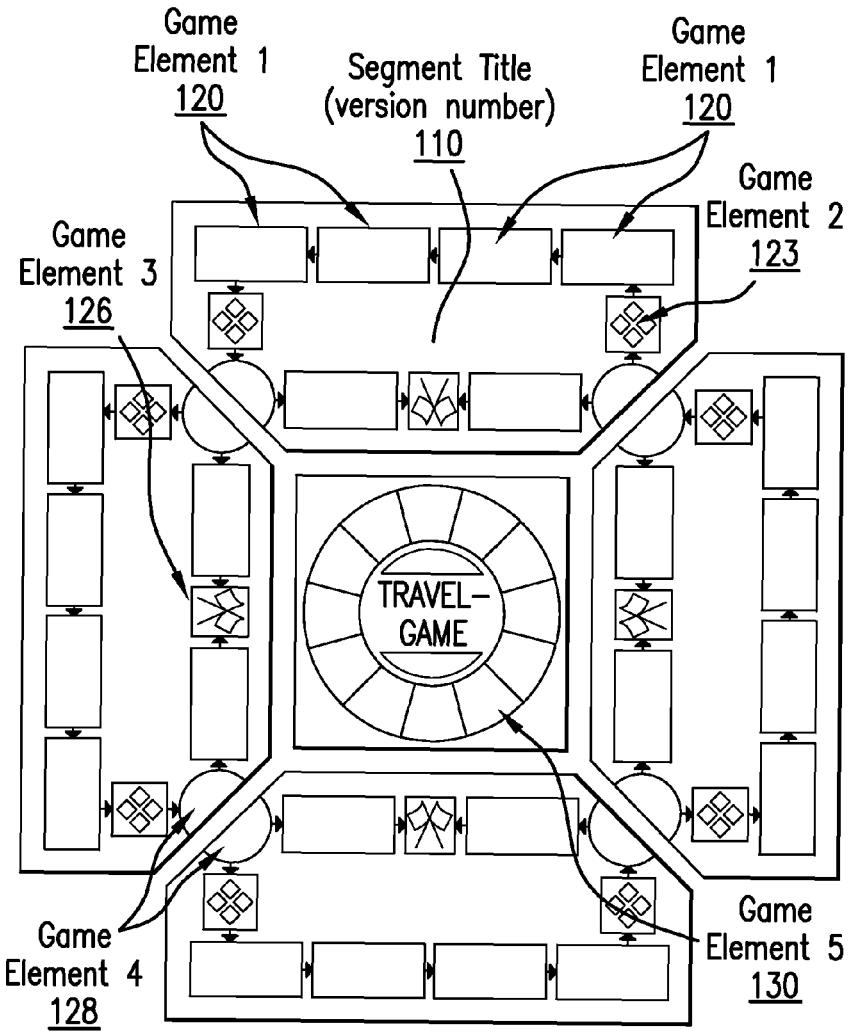
FIG. 1 is an illustration of a customized board game, according to an example embodiment of the present invention.
FIGS. 1B and 1C illustrate segments of the board game, according to that example embodiment of the present invention.
Figure 1B:
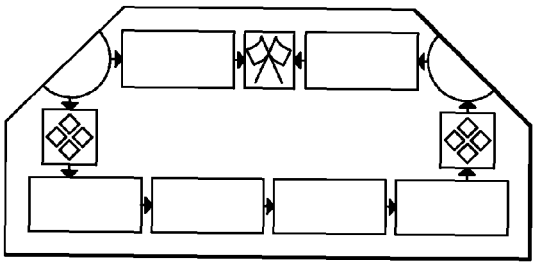

One example implementation of the present invention may include multiple modular/interchangeable game segments. For example, a game segment is illustrated in FIG. 1B, and shown as part of a larger configuration in FIG. 1. Each of these game segments may include a number of game elements, e.g., as shown in FIG. 1. Here, the game is constructed of four polygonal (e.g., half-octagon) game-board segments, where each game-board segment may present a series of elements ("spots"), upon which a player may "land." The series of spots for each game-board segment may be logically connected to form a single game. The game board may include a center segment, such as the square illustrated at the center in FIG. 1, and this segment may include a timing aspect (e.g., a game ending mechanism). Further, each of the game segments, including the center segment, may by interconnected and interchangeable.

Figure 2A:
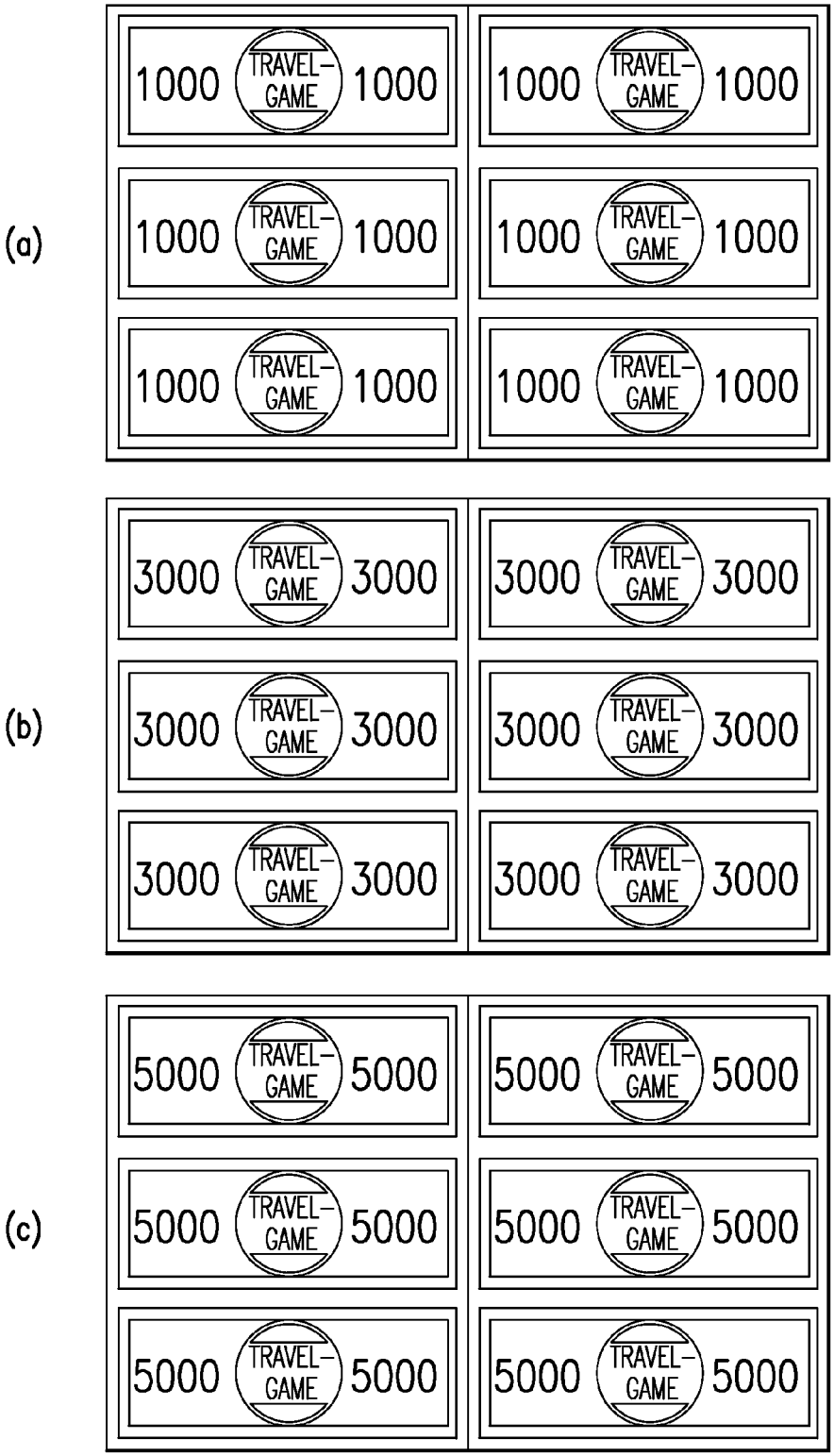
FIG. 2A illustrates printable game currency that is used with an example embodiment of the present invention.

The game elements may include elements independent of the main board. Examples may include: identifying tokens (e.g., a uniquely colored game piece), a timer token, a random number generator (e.g., dice), a game metric (e.g., play money), and game cards. Any token that fits on the game board may be used to represent a player's position in the game, but the game set may come with a standard set of uniquely colored game pieces. Any random number generator may be used to determine player progressions, but the game set may come with one or more standard six-sided dice, other types of dice, a computerized random number generator, or some combination of these. Further, any game metric used to keep track of the progress of each player could be used. In one example embodiment of the present invention, cards of different denominations of "travel points" are held by each player to measure their progress, e.g., as illustrated in FIG. 2A(a)-(c).

Figure 2B:
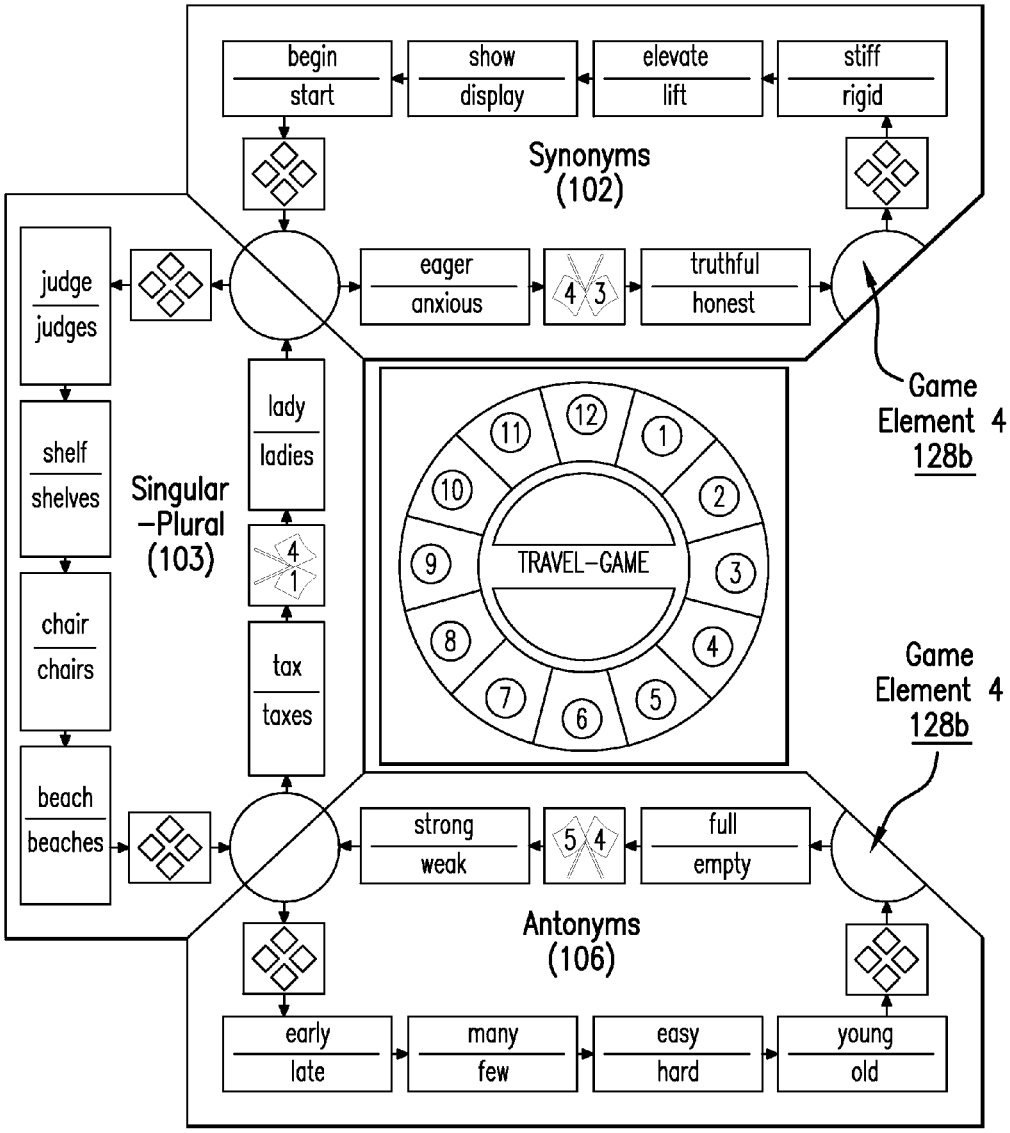
FIG. 2B illustrates an alternative configuration of the customizable board game, according to an example embodiment of the present invention.
Figure 3A:
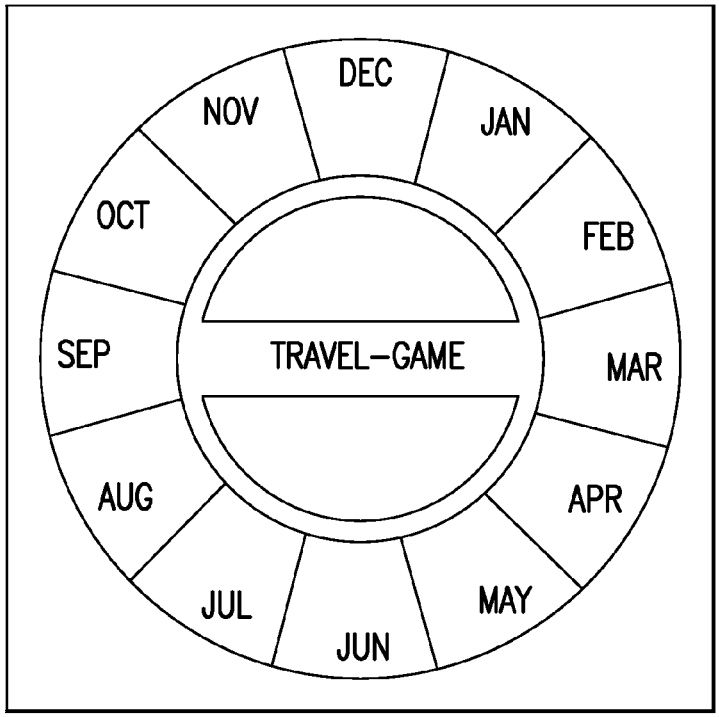
FIGS. 3A to 3G illustrate examples of a time keeper segment for the game board, according to an example embodiment of the present invention.
Figure 3B:
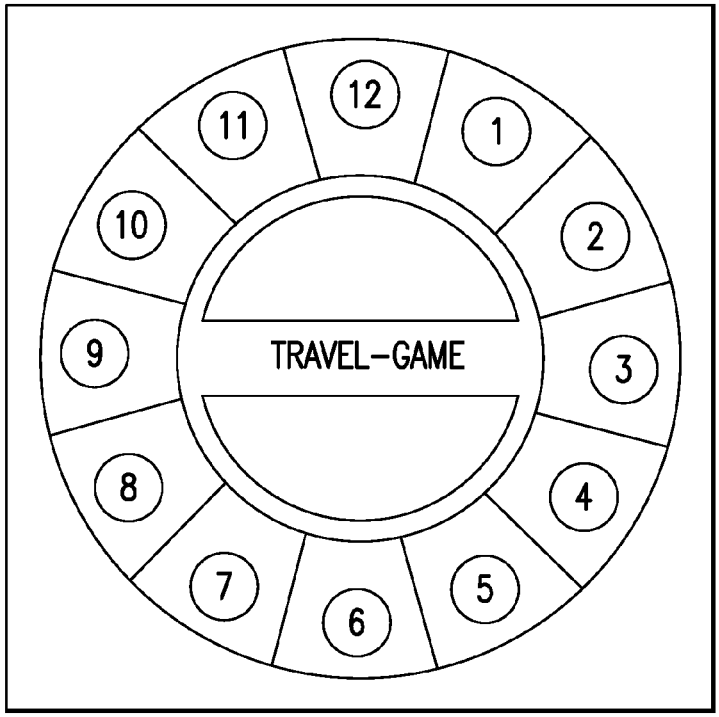
Figure 3C:
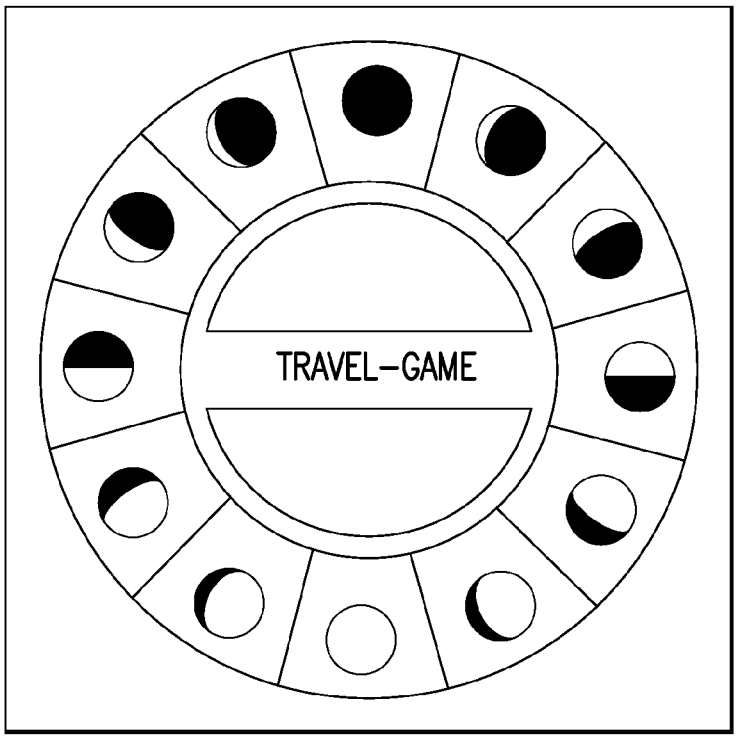
Figure 3D:
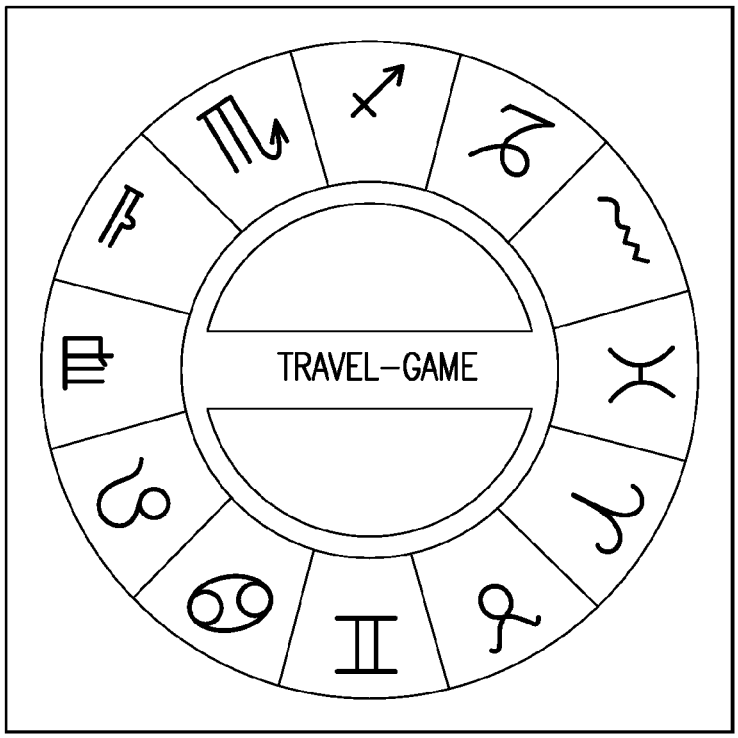
Figure 3E:
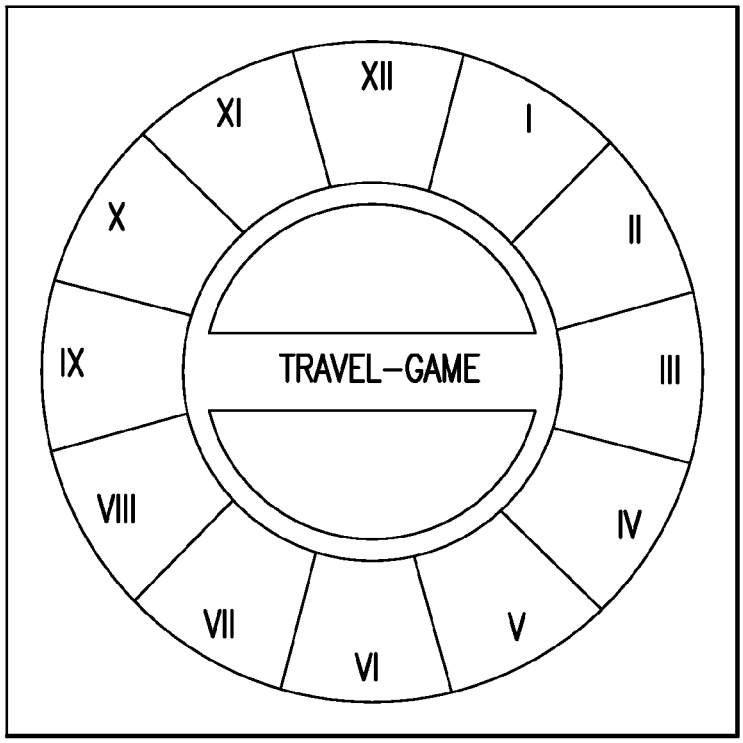
Figure 3F:
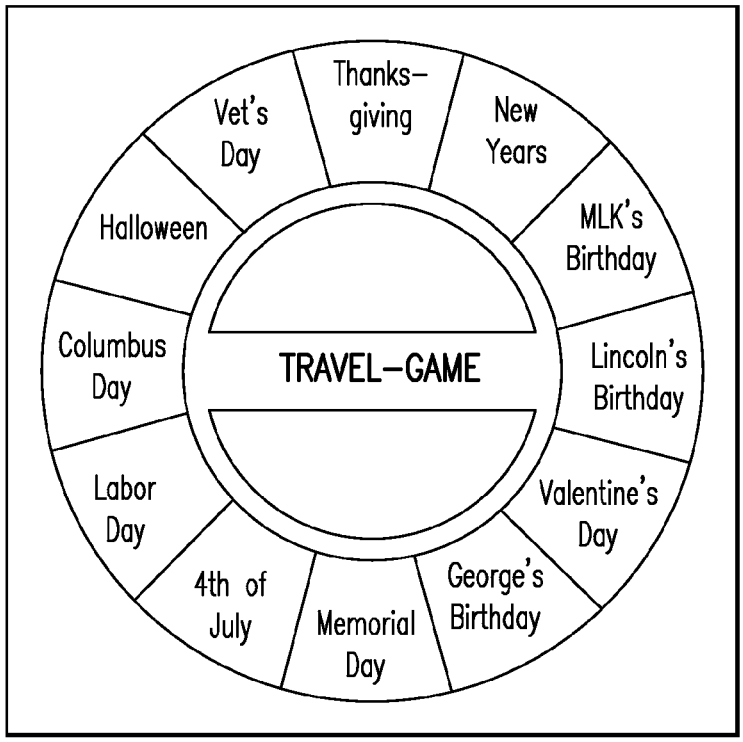
Figure 3G:
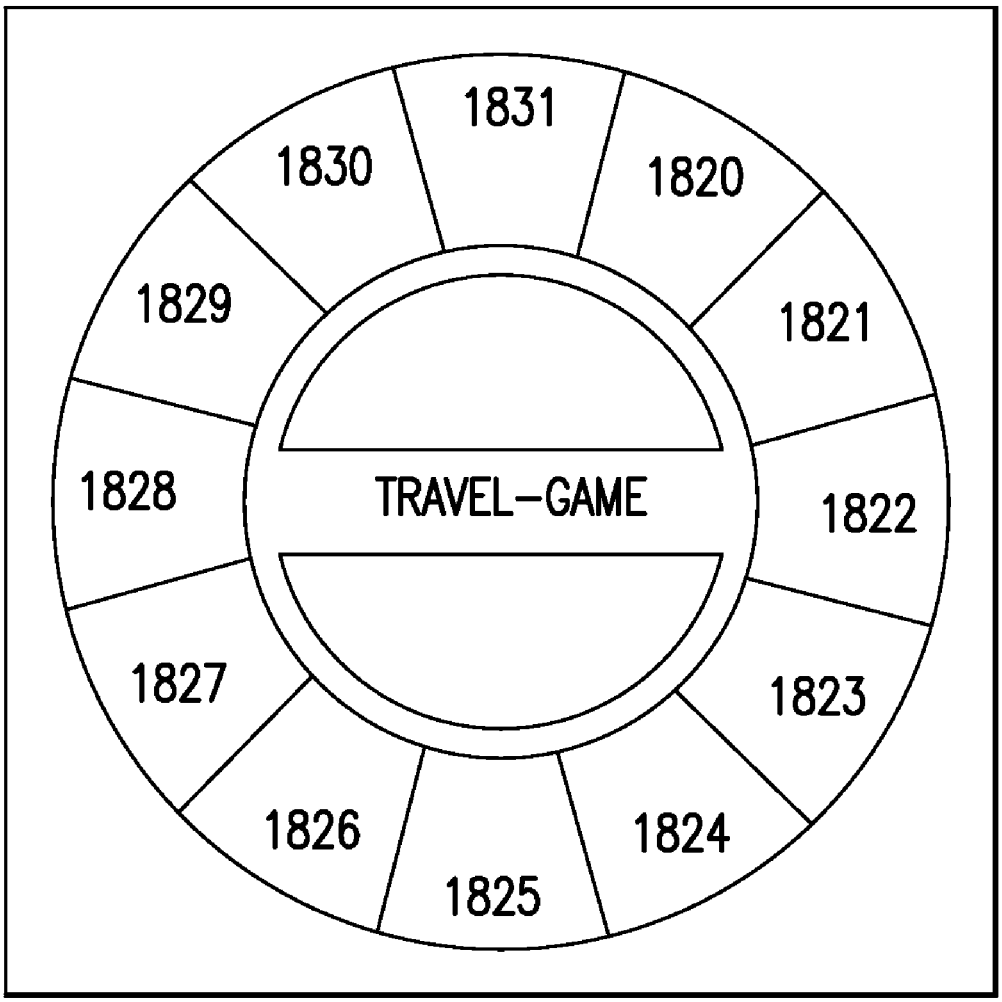
Figure 4A:
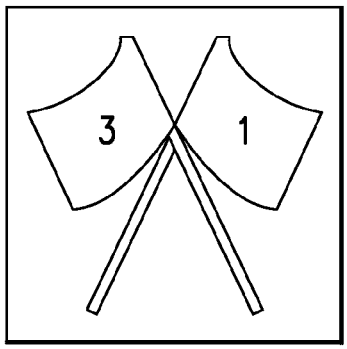
FIGS. 4A to 4D illustrate examples of a game element of the board game, according to an example embodiment of the present invention.
Figure 4B:
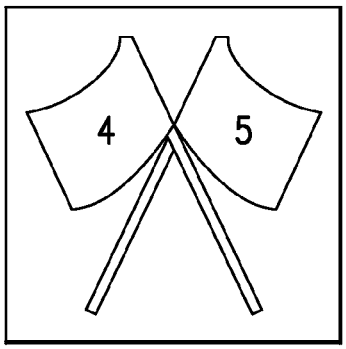
Figure 4C:
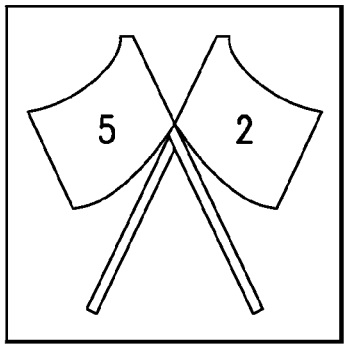
Figure 4D:
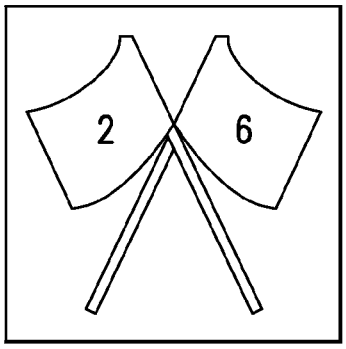

The main portion of the actual board game consists of interchangeable, sectional polygonal pieces. Within each piece, several game "spots" are presented. Between each spot, directional arrows may be presented to define the direction a player on the spot must move. Generally, each segment will include two categories of spots. First, the majority of spots, e.g., game elements 120, may relate to one or more game cards (as described in detail below) and/or include informational items which may be used for teaching the informational items. Second, one or more types of "action" spots may provide additional game dynamics independent of the game cards. Examples of these may include, game element 123, game element 126, and game element 128. Game elements 123 and 126 will be described further, in the context of game play. Game element 128, as illustrated by matching half circles, is used to provide logical continuity between the interchangeable segments. As illustrated, once lined up with the other segments to create the board, each circle spot 128 has two paths a player may choose from, there being two directional arrows pointed into the circle spot 128 and two directional arrows pointed out from the circle spot 128. Alternatively or additionally, the rules may specify which path a player must take (e.g., a path into the segment from which the player did not enter the circle). In another embodiment, the game may be played without all four segments. FIG. 2B illustrates a board with only three of the segments. Since each connecting circle spot 128 has two paths, unconnected circles 128*b* each has one path, and thus, even without a connecting segment, a player path is still defined to and from every spot.

Figure 1C:
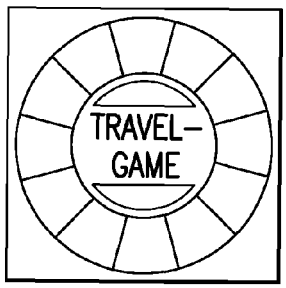

The second portion that forms part of the actual board, is the time keeping segment, e.g., FIG. 1C. As will be discussed below with regard to actual game play, this part of the board may be used to determine when the game ends. Like FIG. 1B, FIG. 1C may be fully customizable, including the number of game elements 130, and the description of those elements. Examples of this may include calendar months, numbers, moon phases, Egyptian symbols, roman numerals, holidays, or historic years, e.g., as illustrated in FIG. 3A to 3G respectively, e.g., depending on the desired game theme. Of course, any set of characters could be used, and the timing circle (e.g., FIG. 1C) may include any number of game elements 130. In one example embodiment, as discussed in more detail below, the timer token is moved from one element 130 to another element 130 after each turn, and the game is over when the timer token is returned to its original location. In another embodiment, the timer token may be moved whenever a player lands on a certain spot, e.g., game element 128. Thus, in these embodiments, the number of game elements 130 may determine the length of the game.

The game segments, e.g. FIGS. 1B and 1C, may be constructed in a number of ways. First, a default or "starter" set of segments may be included in the game kit. However, advantageously, the user will be able to fully customize each segment. Thus, the kit may include blank segments, similar to FIG. 1, where the user may write in the optionally colored, but textually blank game spots. In a preferred example embodiment, the associated software, which is discussed in detail below, may be used to fully customize and print as many game segments as desired, and each segment included, constructed, and/or generated by the associated software may be interconnected and interchangeable. Thus, just a few segments may provide hundreds of combinations and permutations in game board configurations. Further, with the associated software and/or other arrangements for creating a segment, there may be a large number of possible game board configurations. Finally, with game segment sharing systems (e.g., via a network), game board configurations are not even limited to the imagination of the local users, but game board configurations of other users may also be used, leveraging the creativity of users worldwide.

An advantageous consequence of the board being constructed of interchangeable segments is that each segment may be printed on a standard computer printer with a common paper size format (e.g., 8.5"×11"). Though most printers allow for substantially thick paper or cardstock to be used (e.g., "photo-paper"), a user of an example embodiment may find it beneficial to attach the printed segment to a thicker/stronger base. This may be done in a number of ways. For example, the kit may provide four properly shaped rigid objects with a translucent cover into which the printed segments may be inserted. Alternatively, a user may purchase cardstock, poster-board, cardboard, or similarly durable material. The user may then attach (e.g., glue or clamp) the printed game segment to the durable material. The game segments may be attached to similarly sized durable segments, or affixed to a durable surface large enough to accommodate all of the pieces. One example embodiment will provide for a printed game segment to be glued to a substantially identically shaped board, with another printed game segment glued to the reverse side. Thus, the user may select the reverse or obverse side of the board for use in the current game, and select the other side for some future game.

An advantage of example embodiments of the present invention is that ideal construction of the customizable board relies on materials easily accessible in most areas, such as a home/classroom computer with printer, and additional consumer materials from an office supply store (e.g., poster-board, scissors, glue, etc.). It may be appreciated that all of the items can be acquired fairly easily, but the initial kit may also come with starter supplies, including scissors, glue sticks, properly shaped cardboard pieces, a starter selection of game pieces, etc. Those items may be provided along with the software and various game pieces, dice, etc. Additionally, materials may be conserved by affixing new game segments over previous game segments, if those segments are no longer needed.

Game Play

An example embodiment of the present invention may facilitate the following game play. First, each player may select an identifying token (e.g., from a set of uniquely colored game pieces), and places his or her token on a "traffic-circle" (e.g., game element 128). Additionally, a token is placed on a game element of the center circle (e.g., game element 130), which acts as the time keeper. Each player begins the game with a set number of travel points, (e.g., 5000). Travel points may be recorded on paper, an electronic device, or through denominated currency (e.g., play money). Next, each player is dealt some initial number of game cards (e.g., 3) to be held face-up. After the players determine an order, the first player will roll one six-sided die. Any other random number generator is also possible, such as one or more N-sided dice, a software application, or a partitioned spin-dial. For example, numbers may be pre-printed in game element 130, and the center circle may include a spinning dial for each player to spin, where the number the dial lands on is the random number for the player's turn. Such an embodiment would preferably be arranged to not disrupt the time keeper token.

Based upon the resulting number of the die role, the first player will move from the initially selected travel-circle (e.g., game element 128) to a spot on the board corresponding to the resulting number. The player follows the direction indicated by arrows found between elements. When more than one arrow leaves a particular spot, the player may select which path to follow. In an example embodiment of the present invention, the game may be played on a computer system via a user interface, and the system may allow or disallow a directional movement according to stored rules. Each game spot may have different rules associated with it, as an aspect of game play. An example embodiment of the game spots illustrated in FIG. 1 may include the following. Game element 126 may be a pair of flags, each flag having a number 1 to 6 on it, e.g., FIGS. 4A to 4D. When a player lands on this spot the player may be given a choice between doing nothing else or rolling the dice for points. If the player chooses to roll, the player may receive some amount of game points (e.g., 5000) for rolling both numbers on the flags, some amount of game points (e.g., 3000) for rolling one of the numbers on the flags, and a negative amount of game points (e.g., −1000) for rolling neither of the numbers on the flags. It may be appreciated that the option of a no-risk free space (e.g., choosing not to role) would be unnecessary if at least one of the outcomes did not result in a loss of points.

In an example embodiment of the present invention, landing on game element 123 may provide the player an opportunity to move to any spot on the game board for a point-fee (e.g., 1000 points). When a player lands on the circle spot, game element 128, the player may have to pay a "travel tax" of some amount (e.g., 1000 points). Landing on or passing the circle may also trigger a movement by the timer token, advancing the end of the game one unit. In addition to the dynamics of each spot, other player rules may be defined for example embodiments. For example, when a player lands on a game spot occupied by another player, the first player may be allowed to exchange a game card with the second player at the sole discretion of the first player. Additionally, as discussed next, when a player redeems a game card and the color of the game card matches the color currently occupied by the timer token (assuming multi-matching colors of game element 130), the player may get a bonus of some amount (e.g., double the face value of the card). Further, once a player "uses" a card, example game rules may provide that the player is to select a new game card.

Figure 5:
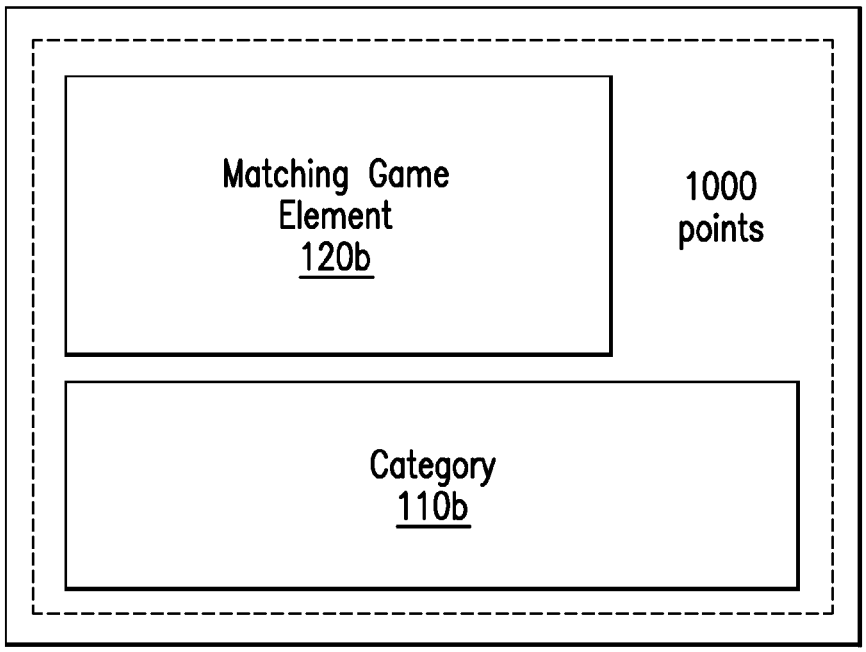
FIG. 5 illustrates an example game card that is used with an example embodiment of the present invention.

The majority of the spots may include game elements 120, and comprise the bulk of the game dynamic. In this example embodiment, these game elements along with matching game cards provide the players the opportunity to collect game points for correct answers to questions (preferably educational). In one example embodiment the question may always be the same, e.g., "Is the information in the game spot correctly associated with the segment title 110?" For example, the segment title may be "adjectives," and the six game element spots 120 of that segment may include: eagerly, green, grass, easy, pretty, and large. Further, each player may have some number of game cards. An example game card is illustrated in FIG. 5. Each game card may match a game element 120, and this may be indicated by a similar game element 120*b* on the game card. The game card may also indicate how much it is worth, e.g., 1000 points, and the game card may indicate the category (110*b*), which will correspond to the segment title 110 of the game segment containing the associated game element 120.

The player may land on any one of game elements 120. If the player does not have an associated game card, then the player may wait for his or her next turn. If however, the player does have an associated game card, the player may indicate whether the segment title/category matches the game element 120. Using the example above, if the player landed on the game element 120 containing the word "grass," and that player had the game card containing the same word "grass," then the player may now have an opportunity to win the points on the card. In this embodiment, the question for the player is indicated as the segment title, e.g., adjectives. The word on the card, that also matches the word on the game element 120 the player landed on, may be an adjective or may be another type of word. Here, grass is a noun. Thus, when the player lands on this spot and has the associated card, that player may win the points on the card if the player correctly indicates that the word "grass" is not an adjective. Had the player landed on the game element 120 with the word "green," and also had that card, the player would win the points indicated on the card if that player indicated that "green" was an adjective. Thus, if the player gets the question right, the player will win the number of points indicated on the game card (e.g., FIG. 5). If the player gets the answer wrong, the player may simply wait for his or her next turn, or the player may lose some number of points (e.g., face value of the game card or some fraction thereof). In another example embodiment, all of the game elements 120 may be correct, and a player may only need to land on a game element 120 for which the player has an associated game card. Here, the game itself is not configured with a test aspect, as each spot is a correct piece of information, but players still learn while playing, as they are exposed to those pieces of information for the duration of the game. Additionally, as discussed below, game quizzes may be given, based on the game segments. In still another example embodiment, the game segments may still have a segment title 110 (e.g. "addition"), but the title 110 may not form a part of the question (e.g., as it did with "is 'green' an adjective?"). In this example embodiment the game element 120 may include the entire question, such as an addition equation (e.g., "4+1=?").

As a result of each function of the different game elements, play may continue, each player in turn, receiving and surrendering game points. Upon a pre-designated event (e.g., whenever a player lands on a game element 128 or after each player has had a turn) the timer token may be advanced one unit. Play continues until the timer token reaches the original position, and the player with the most game points is the winner. The length of the game may be controlled by determining the number of game elements 130, or pre-defining an end location for the timer token. Ties may be resolved with additional play, by some other method, or may be left a tie.

Any number of other supplemental rules and game dynamics are possible. For example, in the embodiment where game segments are constructed by affixing a game segment to both the obverse and reverse side, e.g., where those segments are related, the game may actually be played with twice as many game segments. In this example embodiment, the game cards may include the matching cards for all eight segments. Further, a player may be allowed to flip a game segment over. Taking such an action may cost the player some number of points and/or the forfeiture of a turn. This option may require that no players be present on that game segment to be flipped over, or alternatively, players may be relocated to the corresponding game spot on the newly exposed side. This may add another dynamic to the game, as players flip game segments offensively (e.g., to redeem a game card not currently exposed on the board) or defensively (e.g., to prevent another player from redeeming a game card from a game segment currently exposed on the board). In addition to the added enjoyment of another game dynamic, this arrangement may force players to take a greater awareness of all the game spots (e.g., all the educational information on the board, not just their own three game cards), which may provide a greater educational experience with the game.

The example embodiments may also include game quizzes, as discussed further below. Quizzes, either electronic or printed, may include a blank game segment. The quiz may also include a corresponding number of information correctly associated with the category, or otherwise correct (e.g., "2+3=5"). The quiz may also include a corresponding number of incorrect information. The quiz may then be taken by a player, and that player may be awarded points based on the outcome. This may be given as a pre-game bonus, a post-game bonus, or as part of the game play itself. The quizzes are particularly useful in game embodiments where the board contains only correct information, and questions are not part of the actual game segment dynamic. However, the quizzes are still beneficial in providing added exposure and evaluation of the information presented on the game segments, regardless of the composition of the information.

Software

Figure 6A:
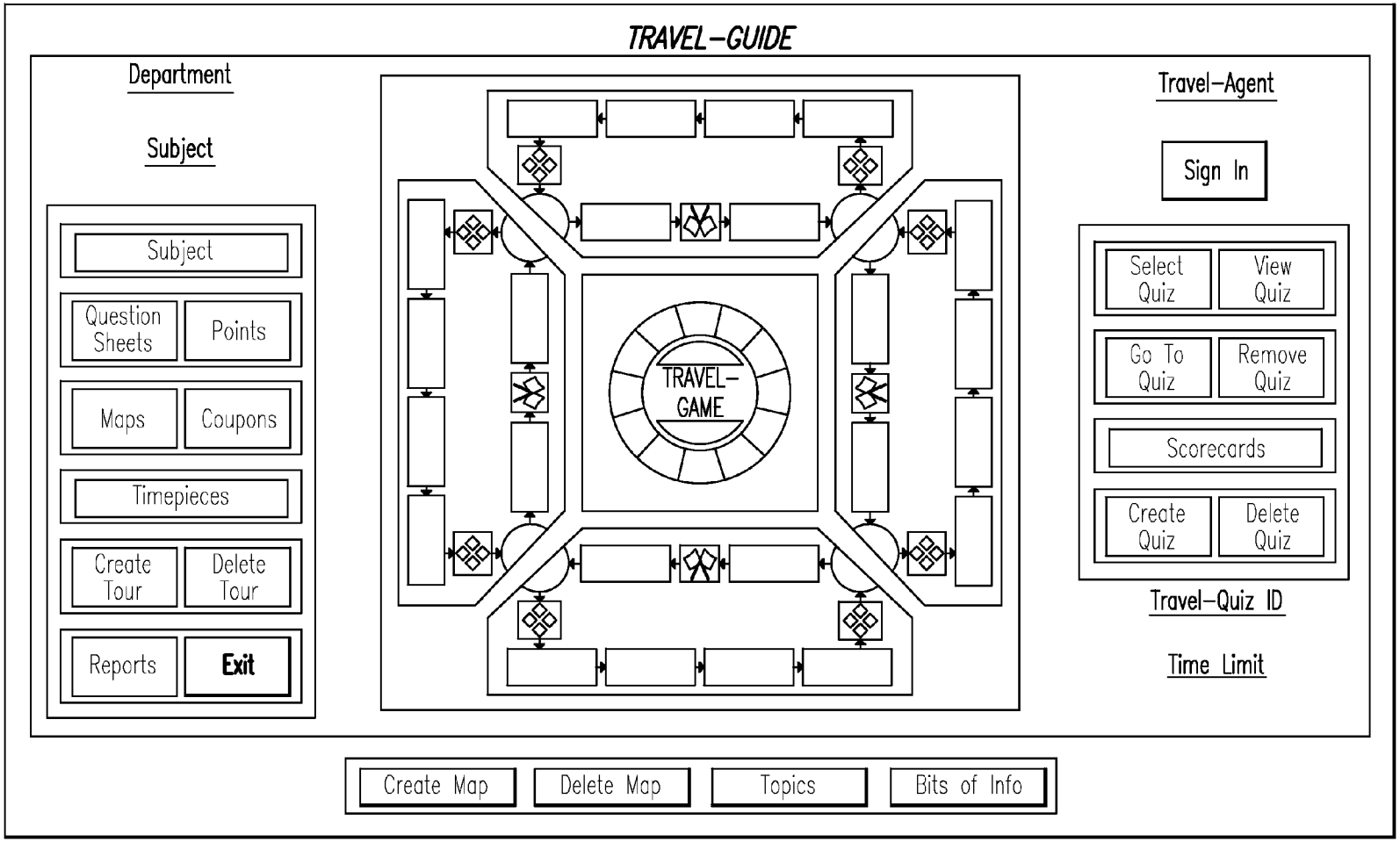
FIGS. 6A to 6K illustrate example user interfaces of the software portion of an example embodiment of the present invention.
Figure 6B:
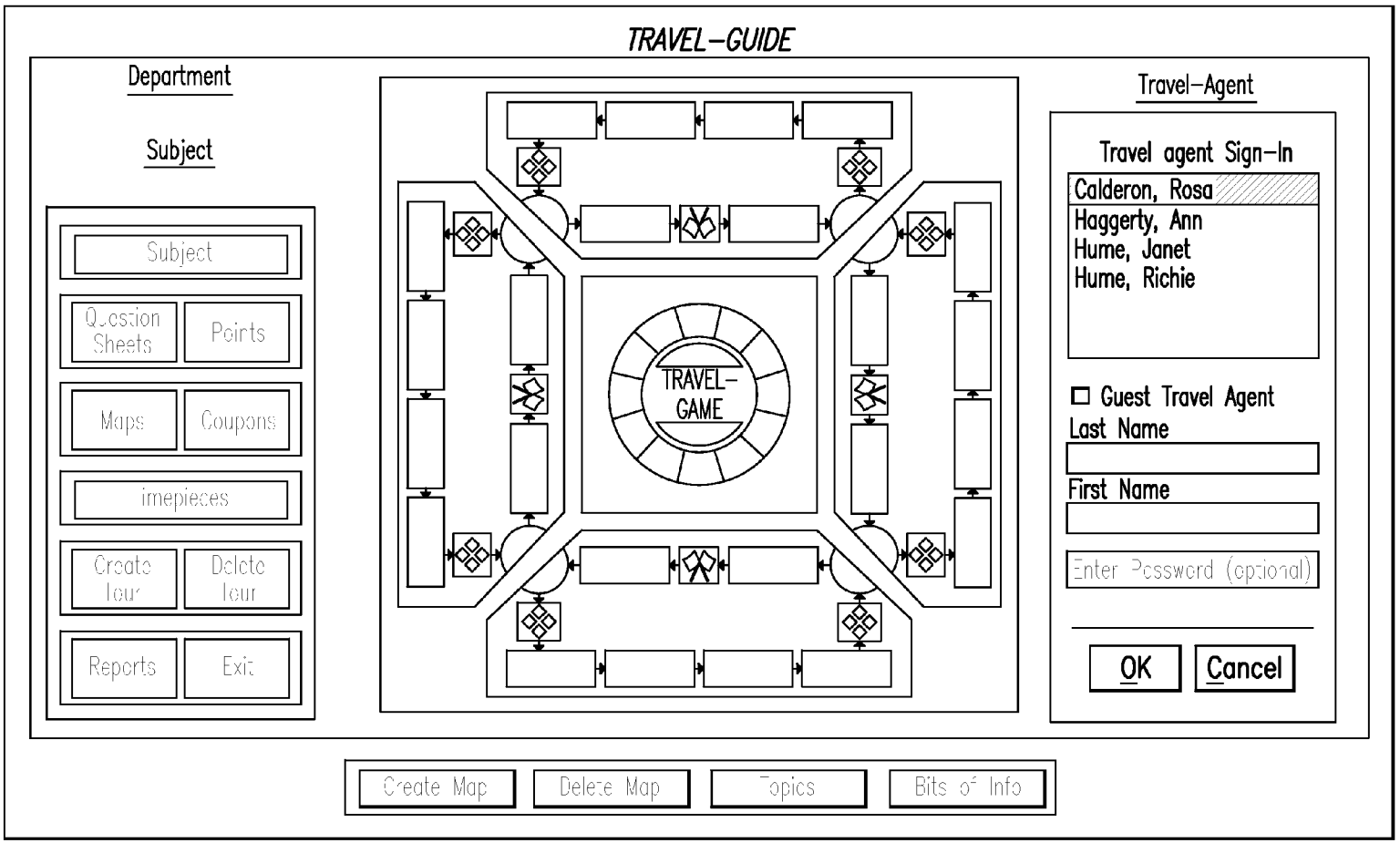
Figure 6C:
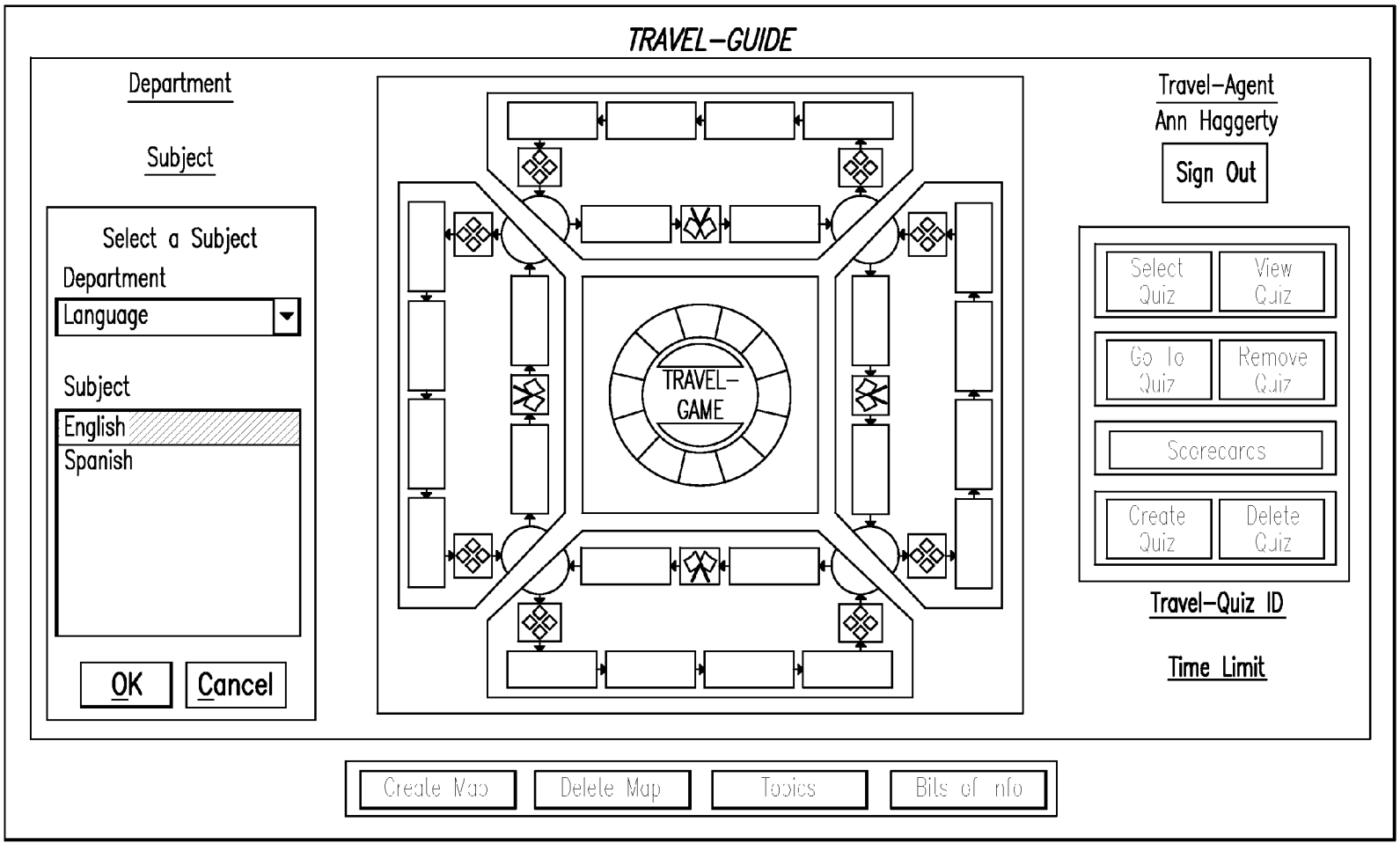
Figure 6D:
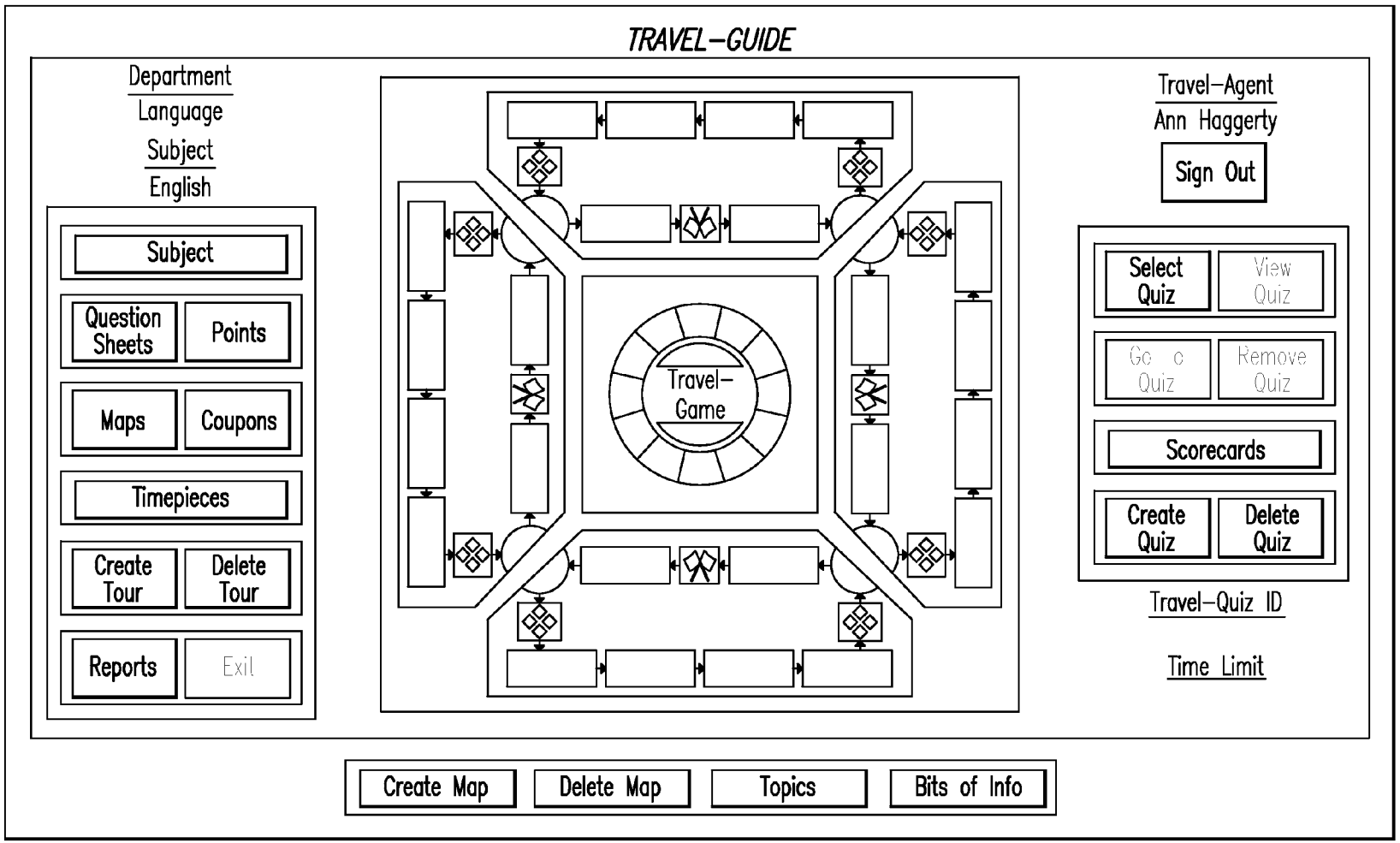

The board game kit may come with associated software. This software may be used in the design of the game segments and also as part of game play. FIG. 6A illustrates an example embodiment of the "Travel-Guide" home page. For the example embodiment of the present invention implemented with a travel theme, users of the software may be referred to as "travel agents." The user may access and/or be shown a list of travel agents, and FIG. 6B illustrates that list, with "Rosa Calderon" highlighted. Options may exist to register a new agent, or use the system as an unregistered "guest" agent. Next, the user may select his or her department and subject. The list of departments/subjects may depend on the identity of the user, or the whole list may be presented to each user. In FIG. 6C, the user has selected language as a department and English as a subject. In FIG. 6D, additional menu buttons are now accessible, as the functions for the Language—English selections are loaded.

Figure 6E:
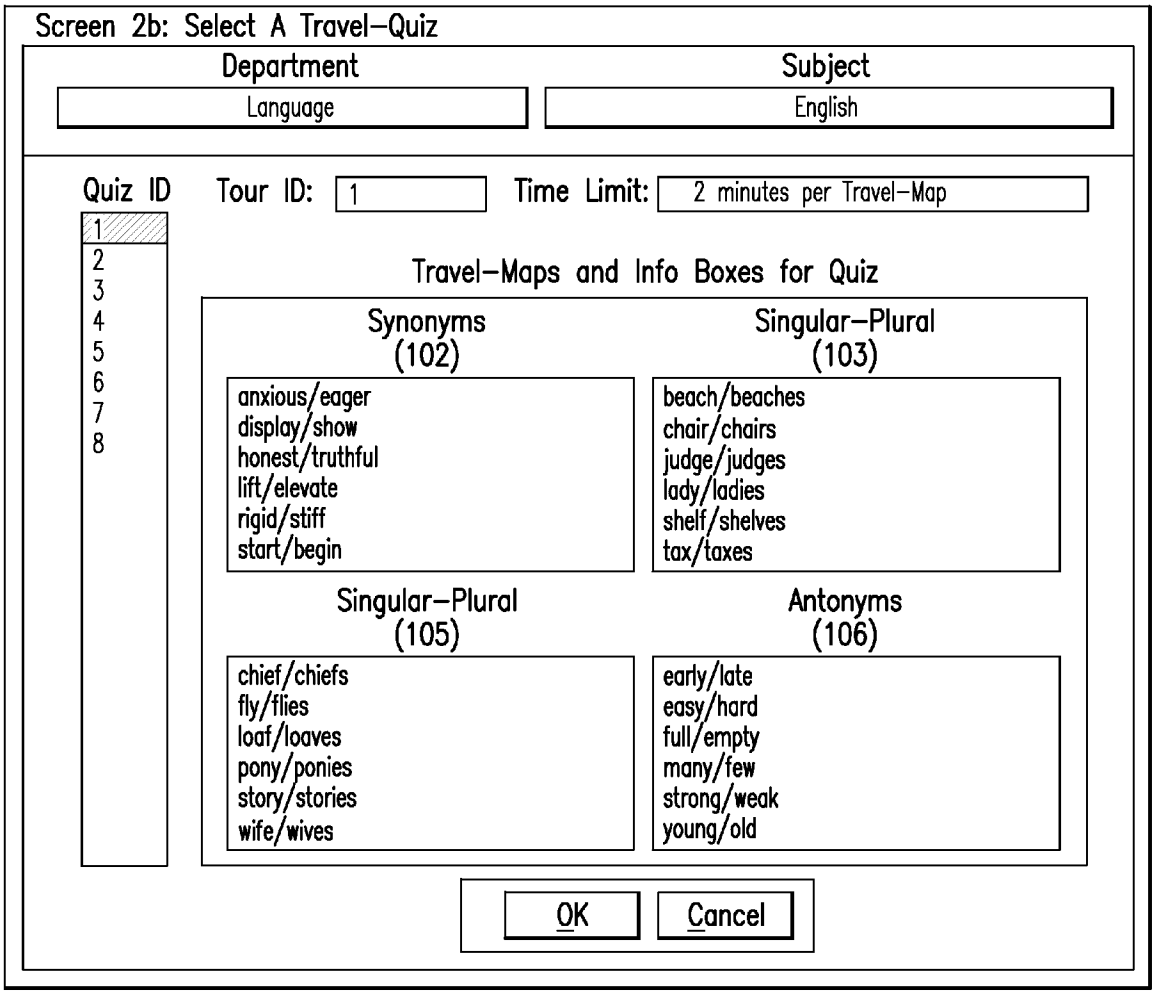

The creation portion of the software has, for example, two primary tasks. The first is the creation or selection of the game segments and corresponding game cards. For example, FIGS. 6G, 6H, and 6I present various example user interfaces for constructing and/or assembling of game segments to form a game board, while FIG. 6K presents an example user interface for constructing corresponding game cards. The second is the creation or selection of an associated game quiz. The user may enter a quiz selection screen by using a "select" menu/button, or any other provided interface. FIG. 6E illustrates an example resulting screen in which eight preloaded quizzes are selectable as list items 1 to 8 in the "Quiz ID" column. Quiz one is currently highlighted, so the information, including, e.g., identifications of the game board segments and informational components of the spaces of the segments, for quiz 1 is found in the main information box. The quiz may be accepted as is or modified. Further, the software may provide tools for constructing a wholly new quiz. Some quizzes may be locked, and therefore not able to be modified. Various options for the quiz may be selected, such as a time limit.

Figure 6F:
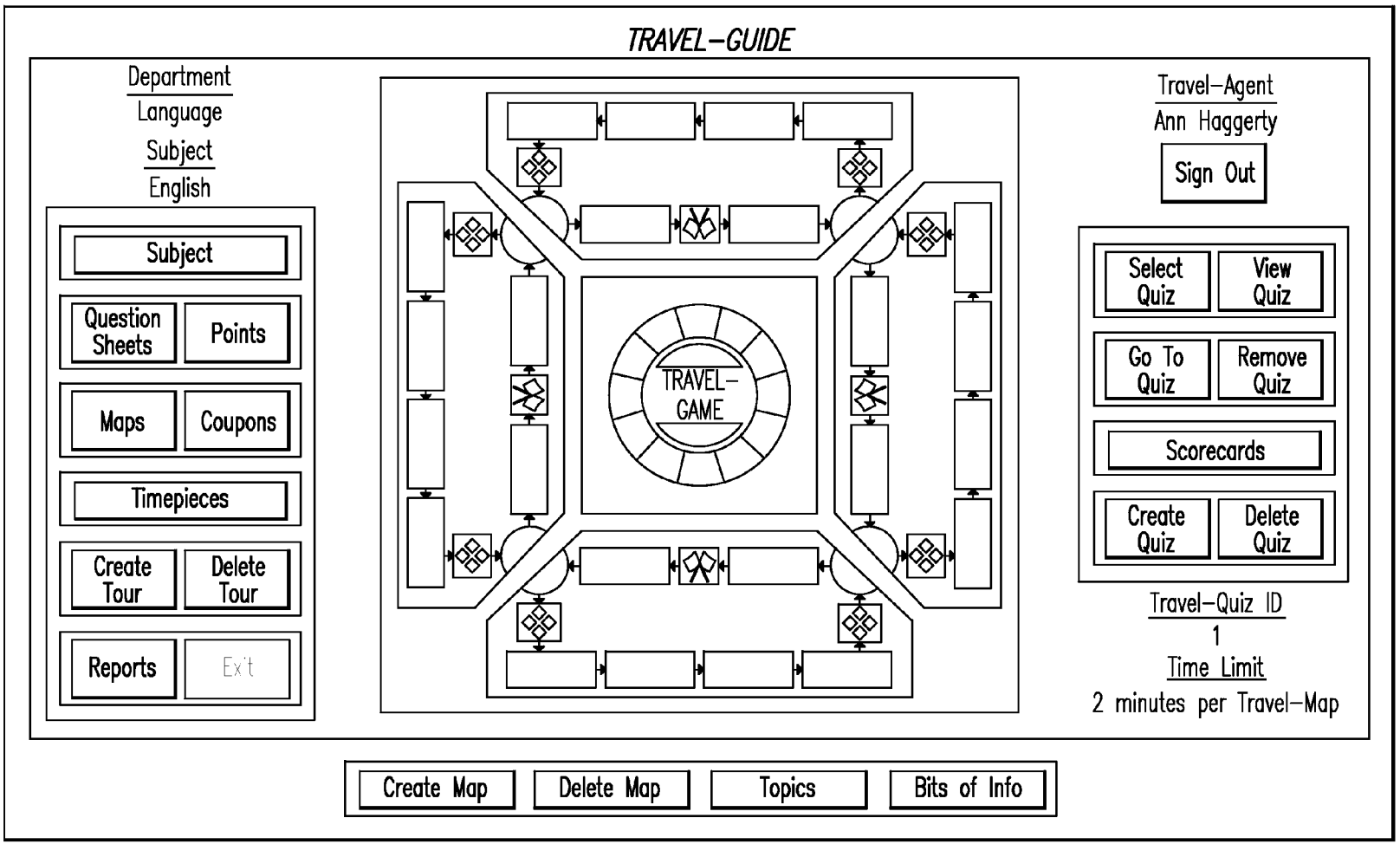
Figure 6G:
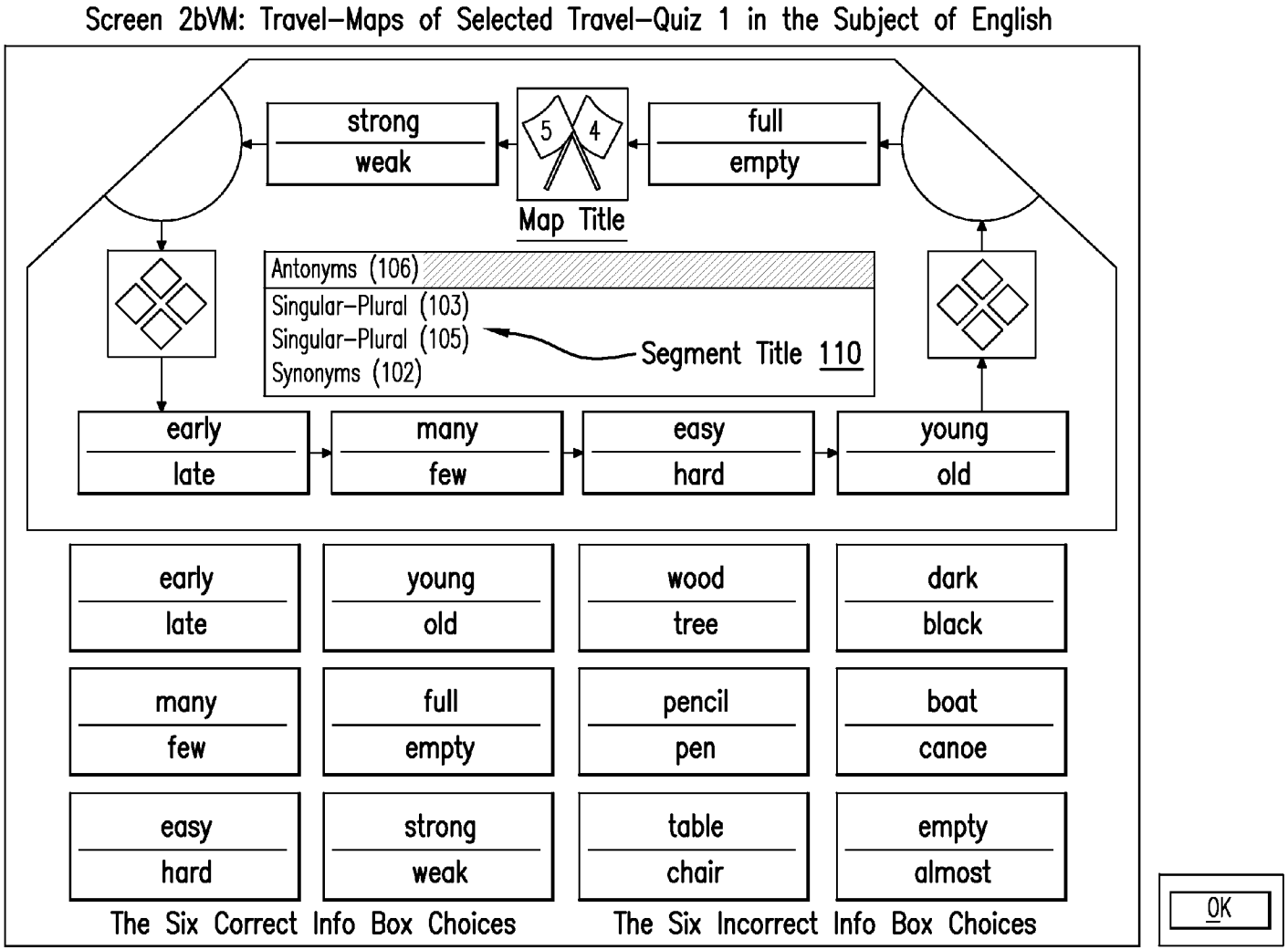
Figure 6H:
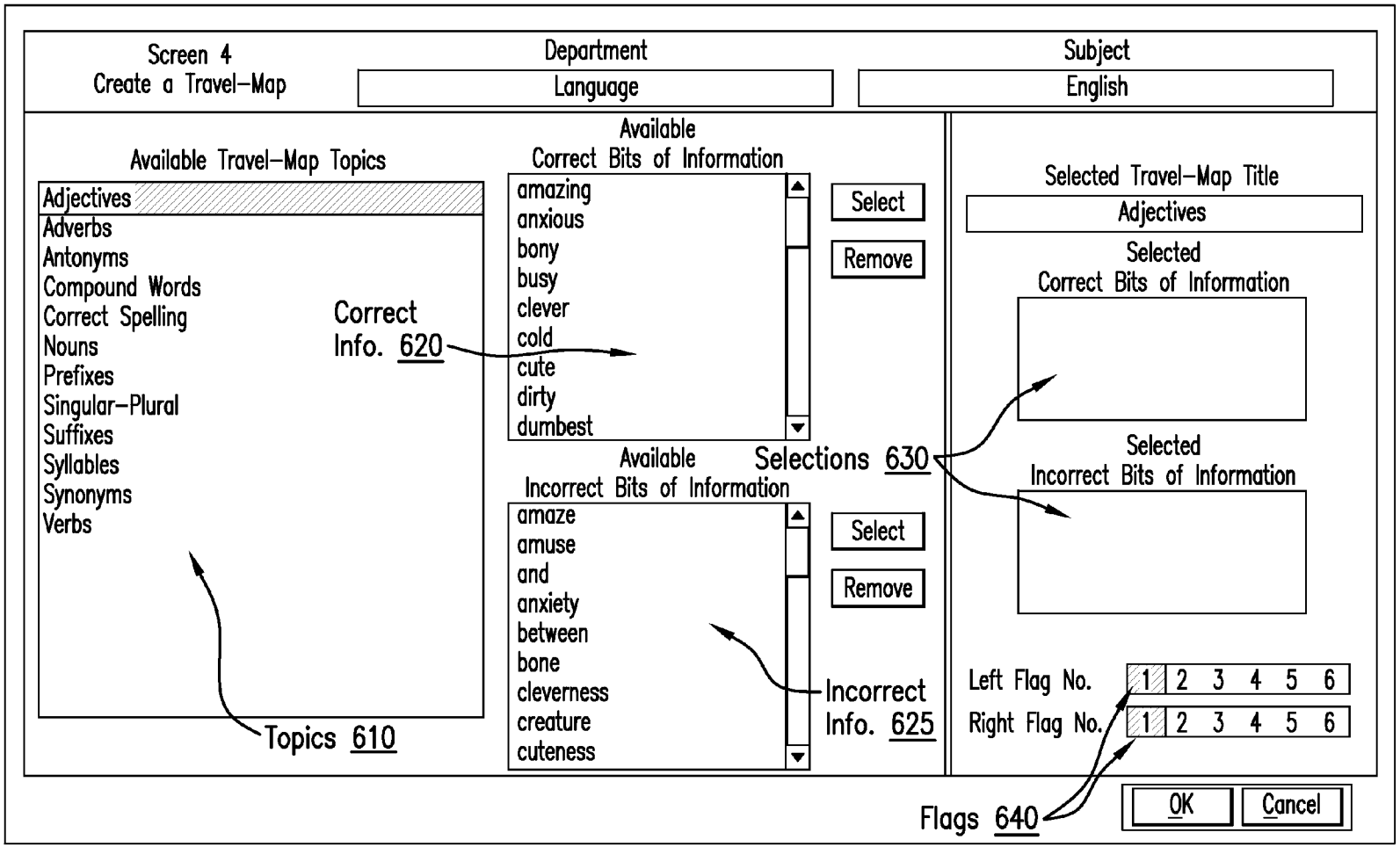
Figure 6I:
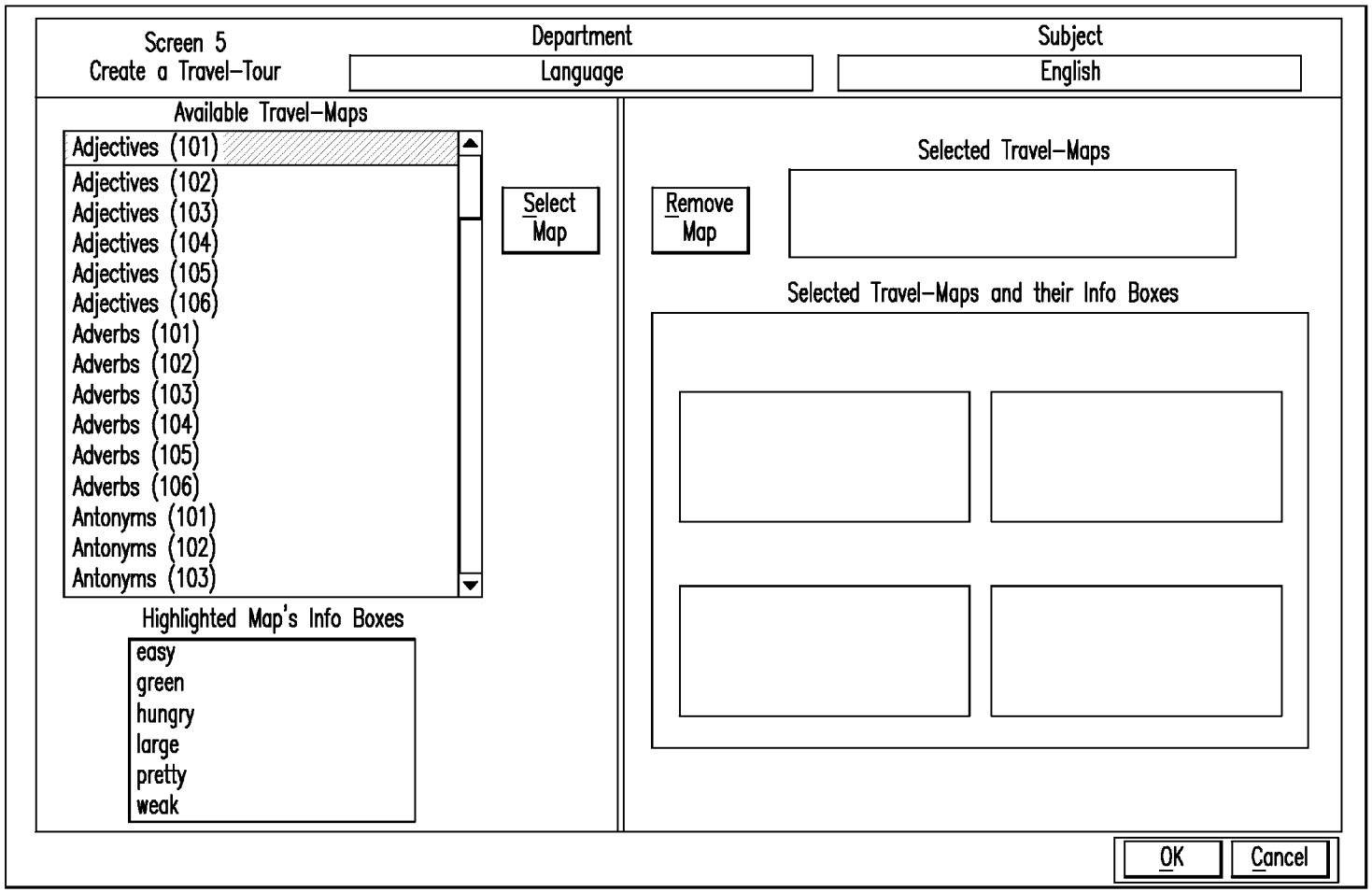

FIG. 6F illustrates a screen after a quiz has been loaded, and thus the selected quiz is identified in the screen. Here, the user may be given three additional interface buttons, "view quiz," "go to quiz," and "remove quiz." As illustrated, the example interface currently presents "Travel-Quiz ID 1" as currently associated with the presented travel map. A user may click "view quiz" to view that quiz, "go to quiz" to start taking or re-taking the quiz, and "remove quiz" to disassociate the current quiz. Quizzes may be given before a game is played, e.g., to provide the information that will be required during game play, to provide a metric, such as bonus game cash based on quiz score, and/or to determine which player goes first, etc. Quizzes may be given after game play to assess post-game knowledge of the subjects. Post-game quizzes may be graded, graded in conjunction with the acquired game points, or administered with no recorded metric. Quizzes may also be given during game play, e.g., on the occurrence of special events, e.g., rolling double sixes. Mid-game quizzes may provide bonus points, or consequences, e.g., losing a turn if the quiz score is below some threshold. As discussed, the quizzes may be related to the game segment information, and administered in any number of ways to supplement players' interaction with the subject material.

As illustrated in FIG. 6E, a travel quiz may include several maps, e.g., game segments. The "Maps" selection button of FIG. 6F may be selected to view the game board segments to which the selected quiz is directed. FIG. 6G is an example screen resulting from selection of the "Maps" selection button. In FIG. 6G, the four maps (e.g., game segments) are presented one at a time. Additionally, other information pertaining to the game spots of the displayed maps, which other information may be used in an administered quiz, may be presented. For example, in FIG. 6G, not only correct answers with respect to the category to which the displayed map corresponds are included in the game spaces, but incorrect answers, which may be presented in a quiz, are also displayed. Each segment title 110 is listed and selectable, which will load that respective segment for viewing. Here, a user may separately inspect each of the, for example, four, maps, along with the associated correct and incorrect information boxes that correspond to the associated game cards of the board game. A selectable option may be provided to enter a map editing interface (not shown), or the user may click the provided "OK" option. In FIG. 6G, game segments are presented one at a time for an easy-to-read and user-friendly presentation. (e.g., according to which segment title 110 is currently selected). However, maps may also be presented in any other combination, e.g., two at a time or all at once, etc. The segment titles are listed with a number, e.g., "Antonyms (106)," which may be the version number for that segment, since the example software may provide any number of segments based on "antonyms."

While preloaded quizzes and maps may be provided, additional tools may be available for constructing, editing, and otherwise modifying the various segments and elements used to construct a board, including user defined quizzes. FIG. 6H illustrates an example screen provided to the user in order to construct a new game segment. A list of preloaded topics may be provided at 610, and additional topics may be added and/or defined by the user. Additionally, for each topic there may be a preloaded set of "correct information" 620 (e.g., for topic "adjectives," a list of adjectives), and for each topic there may be a preloaded set of "incorrect information" 625 (e.g., a list of nouns, adverbs, prepositions, etc.). The user may need to select a set number of each correct/incorrect, and the current selections may be shown in boxes 630. Additionally, other information related to the game segment may be set, e.g., the flag numbers 640. Once finished, the user may save the game segment, and the software may automatically assign a unique version number associated with the title.

Once all of the desired game segments have been defined, a user may construct a board including some number of game segments. In this example embodiment, the user may have to choose a set quantity of four. FIG. 6I shows a screen which may be used to construct a four segment board. Here, the different versions of each segment type are listed for selection, and the user may select four. The user may create a uniform board (e.g., all four adjectives), or may mix and match game segments. Since the example embodiment illustrated in FIG. 6I is under the Language—English selection, each game segment may relate to English. However, in an additional embodiment, the user may be able to mix and match different subjects from the same department and/or different subjects from different departments. Once the board is set, the game cards may be generated automatically, since the cards correspond to the game elements. The user may be given the opportunity to indicate which game cards are already in paper form, and which need to be printed. If desired, the user may initially print all of the cards, and the user may be given options for modifying the card set, e.g., creating doubles of some cards.

Figure 7A:
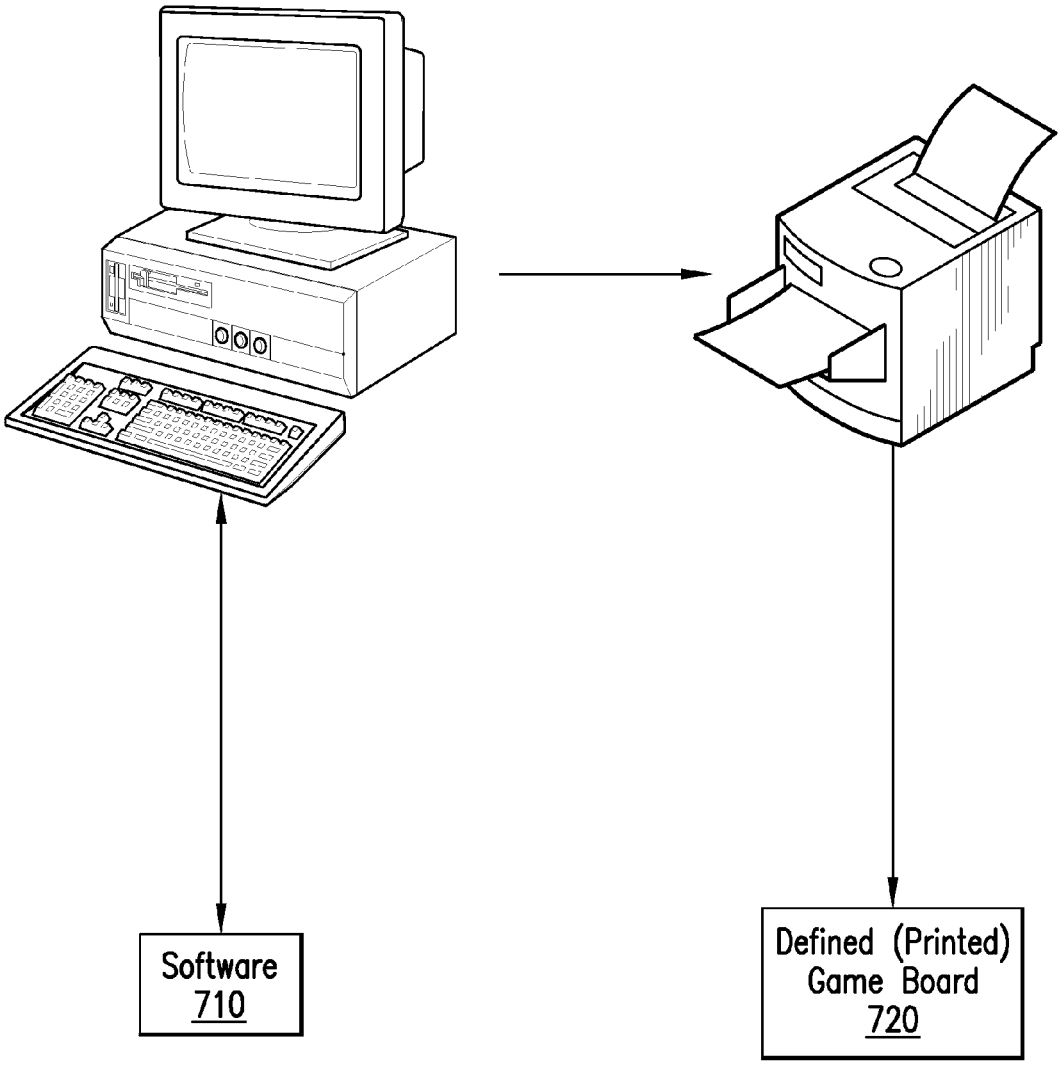
FIG. 7A illustrates an example system used to create a customized board game, according to an example embodiment of the present invention.
Figure 7B:
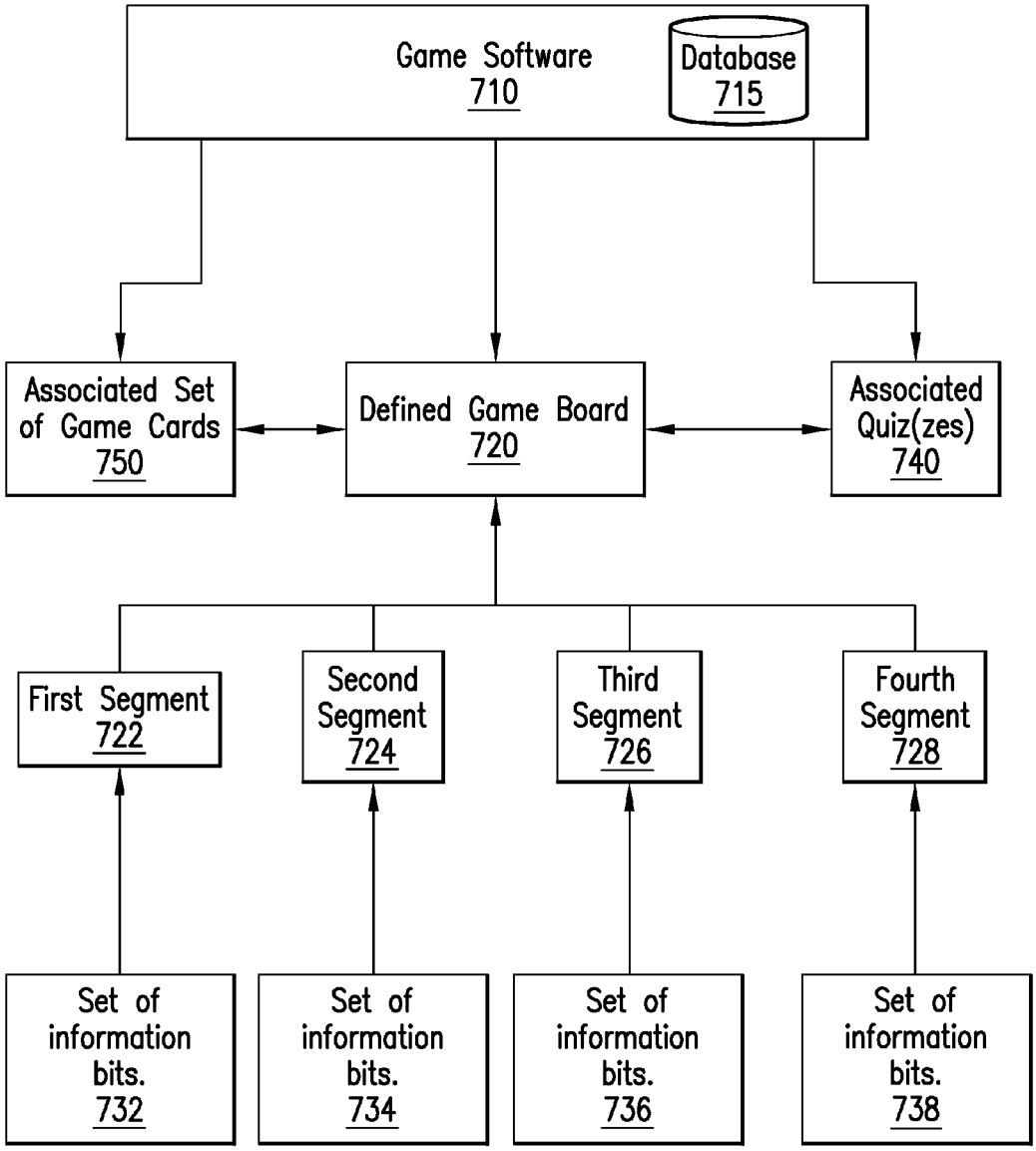
FIG. 7B illustrates the basic structure of the different logical parts of an example embodiment of the present invention.
Figure 8A:
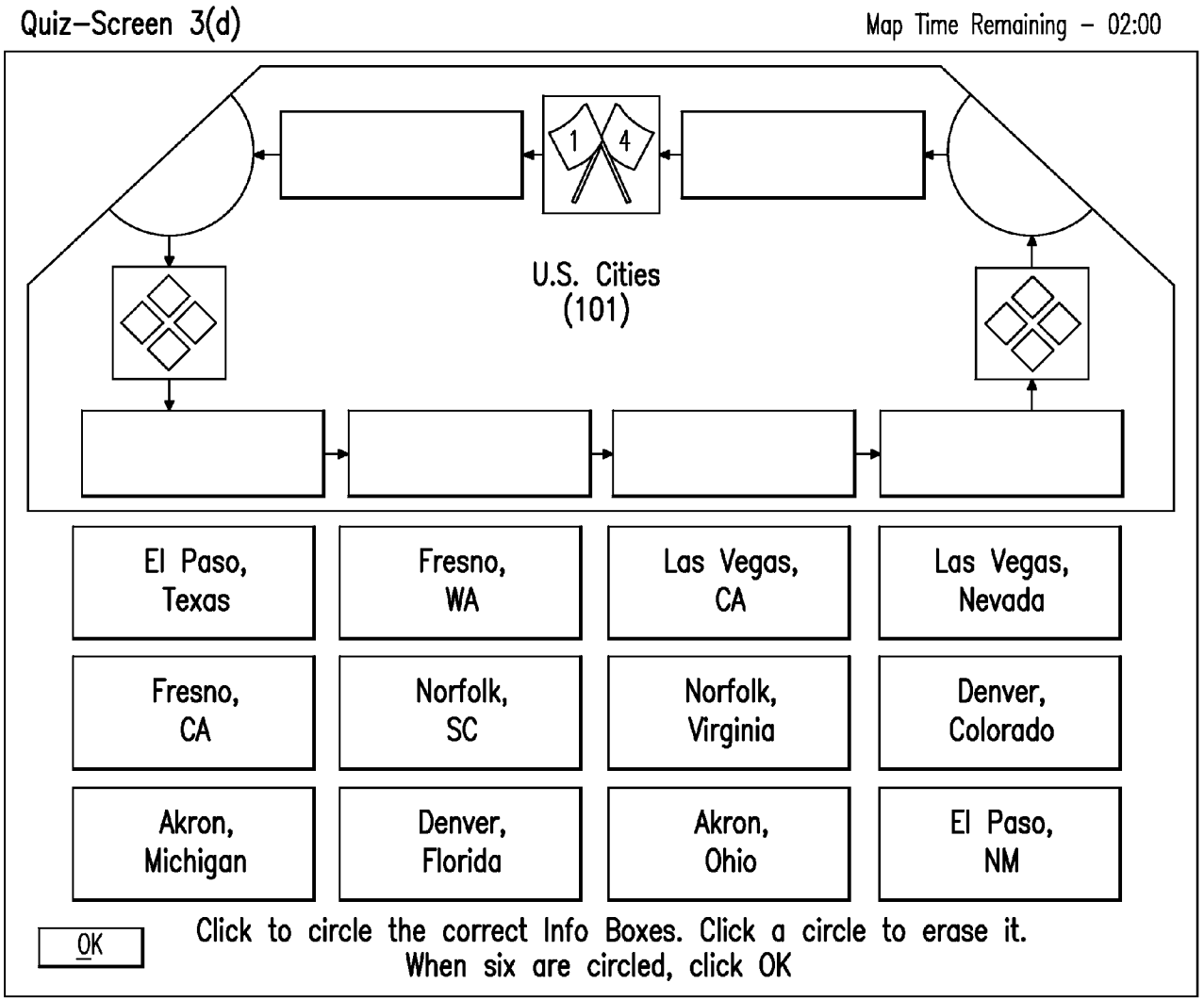

The user may be given the option of generating one or more associated quizzes automatically from the information associated with the selected game segments. Alternatively, the user may select a predefined quiz or construct a new quiz to be associated with the game. In this way, nearly every aspect of the game play material is fully customizable by the user. An example of a computer based quiz is illustrated in FIG. 8A. The general structure of these interrelated parts is illustrated in FIG. 7B. As the user defines a game board 720 via the software 710, the user may select four segments (722, 724, 726, and 728) from among the segments included in the software database 715. The user may then accept a default or customize the set of information bits (732, 734, 736, and 738) associated with the elements of each segment. Thus, the game is defined by the selected segments and the segments are defined by the selected elements (e.g., information bits). The board 720 is then associated with one or more quizzes 740, and a set of game cards 750. As illustrated in FIG. 7A, a game board 720 (e.g., as defined with software 710), may be printed with a standard or custom printer in communication with a standard or custom computer.

Additional features may be fully customizable with the software. For example, the font used, the font size, and the formatting may all be adjusted for each element or all elements. Background art, borders, or other graphics may be added to each element. The travel points metric may be changed to some relevant currency. For example, for a game on U.S. cities, play money resembling U.S. currency may be used. For a game on Europe, Euros or the pre-EU historical currencies of the relevant nations may be used. For a game on the industrial revolution, stock certificates of the primary corporations may be used. All of these options may be fully customizable within the software, for printing prior to game play. Similarly, the user may be given a customization option for the center board section. The user may select from a predefined time keeping segment, e.g., FIGS. 3A to 3G, or be able to define a new timing section.

In addition to facilitating the customization and construction of the game, as described above, the software may be used to facilitate the administering of quizzes, which may form a part of the game play experience. FIG. 8A illustrates one such example. Here, a game segment is presented with blank spots, instead of the usual information. Below the game segment are six pieces of correct information related to the segment title, and six pieces of incorrect information. The student user or player must select the six correct pieces of information within the predetermined time limit. This could be done in any number of ways known in the art, from mere clicking, to a more animated click-and-drag selection process. The player may be scored based on a number of factors, including the number correct, the number incorrect, and the time taken to answer. This map may correspond to a map used in the board with all six spots having correct information.

Alternatively, the game map may be a mix of correct/incorrect information, which a player must identify accurately before receiving the designated points from the associated game card. However, the quiz may still require the selection of all of the correct spots, regardless of the make-up of the actual game board.

The quiz does not need to be administered by the software. The customization and construction aspects of the software allow for paper quizzes to be created automatically and/or manually to be printed out.

Figure 6J:
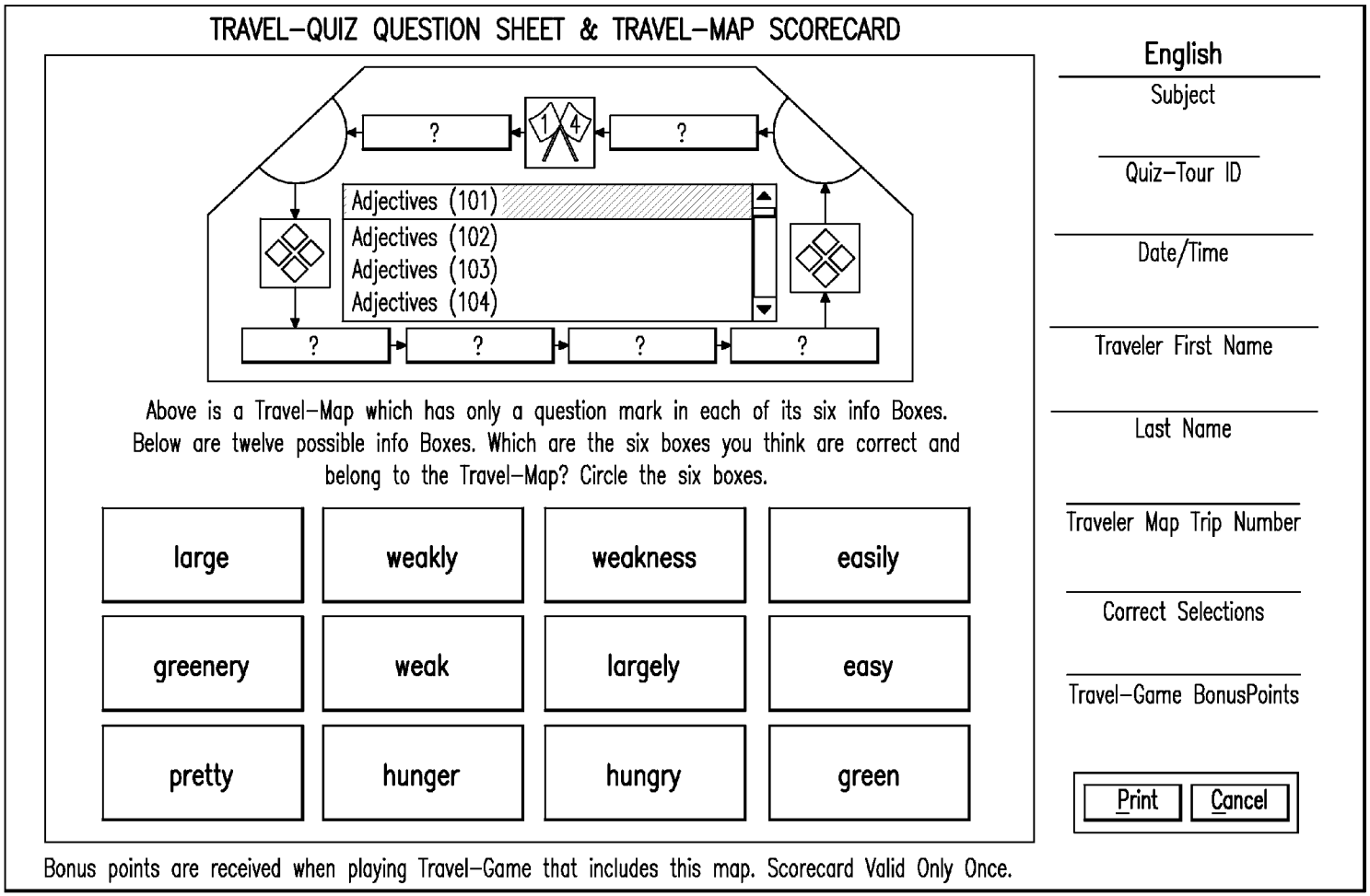
Figure 6K:
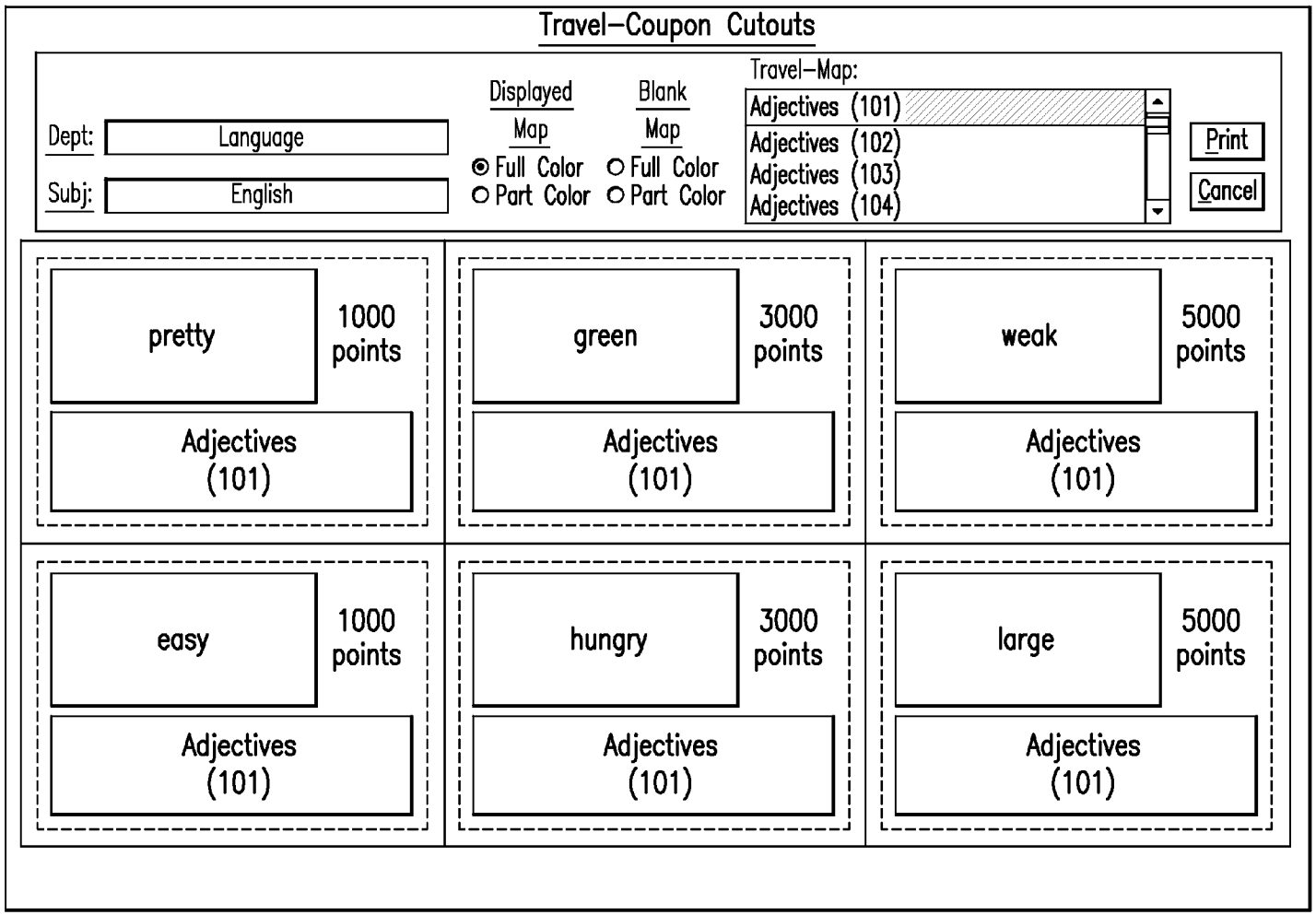

Users may also be given scorecards based on their quiz performance. FIG. 6J illustrates an interface where a user may view and print a scorecard. After taking the quiz illustrated within FIG. 6J, the information on the right of FIG. 6J, including "Travel Game Bonus Points," may be filled in by the computer (e.g., when administered on the computer) or may be filled in by hand (e.g., when administered on paper). The user may save this scorecard for future use, and redeem the card for bonus points at the start of a game or during game play. Users may be allowed to redeem any quiz, or may be limited to only quizzes based on one or more of the game segments for the game board used when the scorecard is redeemed. For example, a teacher may have a periodic game day (e.g., Thursdays, or the first Monday of the month, etc.) where student pick game segments at random to form a game board. This may be done by the computer, or physical game segments may be put in a container and "blindly" selected for use. Then, any student with bonus points from a quiz based on one of those segments, may be allowed to redeem those points for a game bonus (e.g., bonus travel points). In this way, players (e.g., students) are encouraged to take as many quizzes as possible to increase the chance of having bonus points available for the randomly selected segments.

FIG. 8B illustrates an example paper quiz generated by the example software. Players may then take the quizzes on paper. The paper version may be the same, similar, or different than the computer version of the quiz, such as including an area for recording information about the player, score, date, etc. (e.g., the information on the right side of FIG. 6J and/or bottom of 8B). As illustrated in FIG. 8B, bonus points may be recorded on this example paper quiz (e.g., as graded by an administrator of the game, such as a teacher). The quizzes may be given before game play, and the players may be given a starting bonus according to the score received on the quiz. The quizzes may be given after game play, to test the material learned during game play. The players may be given bonus points according to their quiz score, and a winner may be determined based on the sum of game points and bonus points. Bonus points may be given based on whatever quiz was given before, during, or after a game play session, regardless of the quiz or board makeup. Alternatively, as discussed above, use of bonus points may be reserved for only matching game segments. Alternatively, in a graded class situation, the players (e.g., students) may play the game for educational instruction, and then be given the quiz after the game. The result of the quiz may be used for classroom grading purposes.

Additionally, students may be given the quiz during game play, at a certain time. For example, instead of or in addition to the rules previously outlined for game element 123 and/or 126, landing on these spots may allow a player to take a quiz for bonus points. For example, a player may land on game element 126, and be given a number of quizzes based on the numbers inside the flags (e.g., by themselves, or as related to numbers on the dice). If quizzes are administered during the game, it should either be done with a game board that contains both correct and incorrect pieces of information, or the player should be required to take the quiz without looking at the board. Quizzes may be administered one game segment at a time, corresponding to the number of game segments on the board (e.g., four), or any number of other game segments. Further, quizzes may match the game segments of the board, or present game segments that are not being used on the board.

Other Features and Variations

The game software may be provided in any format, as is known in the art, to implement the inventive embodiments described above. Additional system features are also possible. For example, the software may access a network connection, and system users may be able to share their game segments, quizzes, and boards with other system users. In this respect, a central database or peer-to-peer connections may allow the software repository of pre-made elements to be as large as the sum of every user who has constructed/defined a game segment. The material made by others may be distributed freely at their discretion, or may be sold at the discretion of the creator and/or the copyright owner of the software.

Any suitable memory device or combination of memory devices may be used for storing programs and/or data for the implementation of the described methods. For example, the memory devices may include RAM, ROM, disk drives, and/or tape drives. Any suitable processing device embodied in any conventional form may be used for execution of programs for processing data to perform the described computer methods. For example, a PC, laptop, PDA, etc. may be used.

Those skilled in the art can appreciate from the foregoing description that the present invention can be implemented in a variety of forms. Therefore, while the embodiments of this invention have been described in connection with particular examples thereof, the true scope of the embodiments of the invention should not be so limited since other modifications will become apparent to the skilled practitioner upon a study of the drawings, specification, and following claims.

What is claimed is:

1. A system for providing an electronic and material board game, comprising:

a database configured to store:

game segment templates;

game element templates;

default game elements;

user defined game segments, based on the game segment templates, each user defined game segment being selectable for defining a segment of a single logical game board, each segment containing a set of game elements, each corresponding to a different location in the segment; and user defined game elements based on the game element templates, each user defined game element being selectable for inclusion in the user defined game segments, each of the user defined game elements including content that is stored in the database with a designation as one of a correct choice and an incorrect choice; and a processor configured to:

present copies of the game segment template and the game element templates and process user input modifying the copies for defining the user defined game segments and user defined game elements, wherein each of the user defined game segments includes a plurality of game elements based on the game element templates; and generate and output a plurality of the game segments for inclusion in the game board, wherein the game segments are shaped such that the game board is formed by aligning each of the plurality of game segments with the other game segments of the plurality of game segments according to one of: a shape of the game segments and markings on the plurality of game segments.

2. The system of claim 1, wherein the definition of a user defined game segment includes the processor:

receiving a user-selection of one of a plurality of defined categories;

selecting a subset of informational nuggets based on the selected category; and providing the subset of informational nuggets for selection by the user to be included in the user defined game segment.

3. The system of claim 1, wherein each game segment includes a plurality of other elements having associated functions different than the plurality of game elements.

4. The system of claim 1, wherein the processor is configured to issue a respective plurality of game cards to each user, and wherein each of the issued game cards matches a game element of the plurality of game elements.

5. The system of claim 4, wherein, for each game card, the database stores a respective quantitative value and the processor is configured to modify a user game metric based on the quantitative value responsive to a landing on the matching game element for the game card during game play.

6. The system of claim 1, wherein the processor is configured to generate a player quiz based on a game segment, and the generating includes one of: presenting the player quiz on a monitor for electronic administration of the quiz and printing the quiz through a printer for paper administration of the quiz.

7. The system of claim 1, wherein the processor is configured to generate a time keeping segment, shaped such that the time keeping segment fits within the game board.

8. The system of claim 1, wherein the processor and database are in communication with a network, such that the user defined game elements and the user defined game segments are accessible and usable by other users on the network.

9. The system of claim 1, wherein:

each game segment:

is substantially shaped as a half-octagon; and contains at least one game element half such that the game element half lines up with at least one game element half contained in each other of the game segments to form a game element whole;

four game segments are configured to form at least one looped element path on a single game board when lined up to form game element wholes and an empty square shape in the center of the single game board; and the processor is configured to generate a time keeping segment of substantially the same size as the empty square.

10. The system of claim 1, wherein outputting the game board includes one of:

displaying the game board on an electronic visual output device, and communicating with a printer to cause a printing of each game segment for construction of a physical game board.

11. The system of claim 1, wherein all of the game segments are interchangeable with each other.

12. The system of claim 1, wherein at least one game segment is affixed to an obverse side of a physical game segment object having at least one other game segment on a reverse side.

13. The system of claim 12, wherein the physical game segment object is interchangeable between the game segment on the reverse side, the at least one game segment on the obverse side, and any other game segment, such that the game segment on the reverse side, the at least one game segment on the obverse side, and the any other game segment are thereby interchangeably includable in the board.

14. The system of claim 1, further comprising:

a user interface that:

displays a list of selectable content categories; and responsive to a user selection of a content category, displays a list of correct choices and a list of incorrect choices pertaining to the selected category, each entry in the list of correct choices and the list of incorrect choices being selectable for inclusion in a particular one of the user defined game elements.

15. The system of claim 1, further comprising:

a user interface that:

displays a list of selectable game elements, including the user defined game elements; and responsive to a user selection of a game element, adds the selected game element to a particular one of the user defined game segments.

16. The system of claim 1, further comprising:

a user interface that:

displays a list of available ones of the user defined game segments;

displays a preview window showing the contents of all the game elements contained in a user defined game segment that has been selected for previewing;

displays a list of all user defined game segments currently selected for inclusion in the board, together with the contents of those user defined game segments;

provides a tool allowing a user to select any of the list of the available user defined game segments for inclusion in the board; and provides a tool for de-selecting user defined game segments that have been selected for inclusion.

17. The system of claim 1, wherein:

the database stores the content according to content category;

the processor is configured to receive a user selection of a content category for each user defined game segment; and the processor makes available for inclusion in a user defined game segment only those user defined game elements that have content of the same category as the selected content category.

18. A method for providing an electronic and material game, comprising:

storing, in a database:

a game segment template;

game element templates;

default game elements;

user defined game segments, based on the game segment templates, each user defined game segment being selectable for defining a segment of a single logical game board, each segment containing a set of game elements, each corresponding to a different location in the segment; and user defined game elements based on the game element templates, each user defined game element being selectable for inclusion in the user defined game segments, each of the user defined game elements including content that is stored in the database with a designation as one of a correct choice and an incorrect choice;

presenting, by an electronic processor, copies of the game segment template and the game element templates and process user input modifying the copies for defining the user defined game segments and user defined game elements, wherein each of the user defined game segments includes a plurality of game elements based on the game element templates; and generating and outputting, by the electronic processor, a plurality of the game segments for inclusion in the game board, wherein the game segments are shaped such that the game board is formed by aligning each of the plurality of game segments with the other game segments of the plurality of game segments according to one of: a shape of the game segments and markings on the plurality of game segments.

19. The method of claim 18, further comprising:

receiving a user-selection of one of a plurality of defined categories;

selecting a subset of informational nuggets based on the selected category; and providing the subset of informational nuggets for selection by the user to be included in the user defined game segment.

20. The method of claim 18, wherein each game segment includes a plurality of other elements having associated functions different than the plurality of game elements.

21. The method of claim 18, further comprising:

issuing a respective plurality of game cards to each user, wherein each of the issued game cards matches a game element of the plurality of game elements.

22. The method of claim 21, further comprising:

storing, for each game card, a respective quantitative value and the processor is configured to modify a user game metric based on the quantitative value responsive to a landing on the matching game element for the game card during game play.

23. The method of claim 18, further comprising:

generating a time keeping segment shaped such that the time keeping segment fits within the game board.

24. A non-transitory computer-readable storage medium encoded with instructions configured to be executed by a processor, the instructions which, when executed by the processor, cause the performance of a method, the method comprising:

storing in a database:

a game segment template;

game element templates;

default game elements;

user defined game segments, based on the game segment templates, each user defined game segment being selectable for defining a segment of a single logical game board, each segment containing a set of game elements, each corresponding to a different location in the segment; and user defined game elements based on the game element templates, each user defined game element being selectable for inclusion in the user defined game segments, each of the user defined game elements including content that is stored in the database with a designation as one of a correct choice and an incorrect choice;

presenting copies of the game segment template and the game element templates and process user input modifying the copies for defining the user defined game segments and user defined game elements, wherein each of the user defined game segments includes a plurality of game elements based on the game element templates; and generating and outputting a plurality of the game segments for inclusion in the game board, wherein the game segments are shaped such that the game board is formed by aligning each of the plurality of game segments with the other game segments of the plurality of game segments according to one of: a shape of the game segments and markings on the plurality of game segments.

* * * * *